US011958661B2

(12) United States Patent
Ciccone

(10) Patent No.: US 11,958,661 B2
(45) Date of Patent: Apr. 16, 2024

(54) LID AND CONTAINER ASSEMBLY

(71) Applicant: Top Grade Molds Ltd., Mississauga (CA)

(72) Inventor: Vincenzo Ciccone, Kleinburg (CA)

(73) Assignee: TOP GRADE MOLDS LTD., Mississauga (CA)

( * ) Notice: Subject to any disclaimer, the term of this patent is extended or adjusted under 35 U.S.C. 154(b) by 0 days.

(21) Appl. No.: 17/949,696

(22) Filed: Sep. 21, 2022

(65) Prior Publication Data

US 2023/0093646 A1 Mar. 23, 2023

Related U.S. Application Data

(60) Provisional application No. 63/247,050, filed on Sep. 22, 2021.

(51) Int. Cl.
*B65D 43/02* (2006.01)

(52) U.S. Cl.
CPC ..... *B65D 43/0208* (2013.01); *B65D 2543/00092* (2013.01); *B65D 2543/00296* (2013.01); *B65D 2543/005* (2013.01); *B65D 2543/00537* (2013.01); *B65D 2543/00555* (2013.01); *B65D 2543/00648* (2013.01);
(Continued)

(58) Field of Classification Search
CPC ..... B65D 43/0208; B65D 2543/005; B65D 43/0256; B65D 2543/00092; B65D 2543/00296
See application file for complete search history.

(56) References Cited

U.S. PATENT DOCUMENTS 2,296,599 A 9/1942 Costello
3,860,141 A 1/1975 Hawk
(Continued)

FOREIGN PATENT DOCUMENTS

CA 2163306 5/1997
CA 2474312 A1 1/2005
(Continued)

OTHER PUBLICATIONS

International Search Report for Application No. PCT/CA2022/051402 Dec. 25, 2022.
(Continued)

*Primary Examiner* — Jeffrey R Allen
(74) *Attorney, Agent, or Firm* — Smart & Biggar LP

(57) ABSTRACT

A lid for a container assembly is disclosed. The lid is configured for locking engagement with the container such that accidental or unintentional removal of the lid from the container is resisted. The lid includes an outer skirt that overlies the outer surface of the container about an upper rim. The outer skirt includes a plurality of lid locking members that are disposed at spaced apart intervals about the outer periphery of the skirt and extend inwardly, relative to the outer skirt, for engaging an outwardly extending container lip. Disposition of the lid on the container is with effect that the plurality of lid locking members deflect outwardly as the lid is displaced downwardly over the container lip, the lid locking members returning to their inwardly disposed position once clear of the lip. The inward disposition of the lid locking members effects a robust engagement between the container and lid.

20 Claims, 29 Drawing Sheets

(52) U.S. Cl.
CPC ..... *B65D 2543/00685* (2013.01); *B65D 2543/00722* (2013.01); *B65D 2543/00805* (2013.01)

(56) References Cited

U.S. PATENT DOCUMENTS

| | | | | |
|---|---|---|---|---|
| 4,385,708 | A | | 5/1983 | Curry |
| 4,625,876 | A | | 12/1986 | Bullock |
| 4,711,364 | A | | 12/1987 | Letica |
| 4,735,337 | A | | 4/1988 | Von Holdt |
| 4,881,656 | A | | 11/1989 | Chumley et al. |
| 4,930,656 | A | | 6/1990 | Blanchette |
| 4,971,220 | A | | 11/1990 | Kaufman et al. |
| 5,046,632 | A | | 9/1991 | Bordner |
| 5,065,887 | A | | 11/1991 | Schuh et al. |
| 5,238,135 | A | | 8/1993 | Landis |
| 5,294,015 | A | | 3/1994 | Landis |
| 5,366,104 | A | | 11/1994 | Armstrong |
| 5,395,003 | A | | 3/1995 | Matsuda |
| 5,443,853 | A | | 8/1995 | Hayes |
| 5,538,154 | A | * | 7/1996 | Von Holdt ..... B65D 43/0256 220/784 |
| 5,540,349 | A | | 7/1996 | Philips |
| 5,626,251 | A | | 5/1997 | Luburic et al. |
| 5,730,309 | A | | 3/1998 | Jiradejnunt et al. |
| 5,873,484 | A | | 2/1999 | Clute et al. |
| 6,068,151 | A | | 5/2000 | Recendez |
| 6,279,774 | B1 | | 8/2001 | Clute et al. |
| 6,543,635 | B2 | | 4/2003 | Ciccone |
| 6,619,498 | B2 | | 9/2003 | von Holdt, Jr. |
| 6,688,483 | B2 | | 2/2004 | Davis |
| 6,779,676 | B2 | | 8/2004 | Ciccone |
| 7,063,230 | B2 | | 6/2006 | Ciccone |
| 2004/0079757 | A1 | | 4/2004 | Ciccone |
| 2012/0292323 | A1 | | 11/2012 | Young et al. |

FOREIGN PATENT DOCUMENTS

| | | | |
|---|---|---|---|
| CA | 3033624 | A1 | 2/2018 |
| DE | 4321649 | A1 | 1/1995 |
| EP | 0052172 | | 5/1982 |
| EP | 0723918 | | 7/1996 |
| EP | 1370473 | B1 | 12/2003 |
| FR | 2103410 | A1 | 4/1972 |
| WO | 2002074633 | A1 | 9/2002 |
| WO | 2021223033 | A1 | 11/2021 |

OTHER PUBLICATIONS

International Search Report and Written Opinion dated Dec. 25, 2022 for Application No. PCT/CA2022/051402.

* cited by examiner

PRIOR ART

LID AND CONTAINER ASSEMBLY

CROSS-REFERENCE TO RELATED APPLICATIONS

This application claims the benefit of priority to U.S. Provisional Application No. 63/247,050 filed Sep. 22, 2021, titled "LID AND CONTAINER ASSEMBLY", the contents of which are hereby expressly incorporated into the present application by reference in their entirety.

FIELD

This disclosure relates generally to containers and, in particular, to a lid for a container, the lid having a robust lid locking mechanism for providing a secure interlock between the lid and container.

BACKGROUND

Containers or container assemblies for heavy duty or high performance applications are required to meet performance standards to ensure that the contents of the containers remain sealed and safely contained within the closed container assembly in the event that the container assembly is dropped, knocked-over, or otherwise mishandled. Ensuring that the lid remains securely locked or engaged in position on the container is especially important when the container is used for storing hazardous, toxic and/or dangerous materials. Accordingly, containers with lids that provide a robust interlock between the lid and the container are desirable. Additionally, lids for containers that are able to provide a robust interlock and that offer reduced manufacturing and overall materials costs are also desirable.

Accordingly, there is a need for lids for container assemblies that have an effective locking mechanism system for providing a robust interlock with the container, and that offer simplified manufacturing, reduced materials and overall costs.

SUMMARY OF THE INVENTION

In accordance with one aspect of the present disclosure, there is provided a lid for a container, the container having a closed bottom end and a container wall element defining an open, interior container space, the container wall element having an upper rim defining an open end of the container and including an outwardly projecting container lip defining a lid-locking receiving space. The lid comprises a central panel; a peripheral member extending from a periphery of the central panel, the peripheral member having: an inner wall member extending from the periphery of the central member; an outer skirt defining an outer perimeter of the lid and disposed in spaced apart relationship from the inner wall member such that a container rim-receiving space is defined between the inner wall member and the outer skirt that is configured for receiving the upper rim of the container; a plurality of lid locking members defined within the outer skirt and disposed at spaced apart intervals about the outer skirt, each one of the plurality of lid locking members, independently, extending from the outer skirt to a distal end that is free from connection to the outer skirt; and an inwardly projecting ridge extending from an inner surface of the outer skirt and extending about the inner circumference of the outer skirt such that an inwardly projecting ridge portion is disposed between adjacent ones of the plurality of lid locking members. The plurality of lid locking members are each, independently, configured to flex, relative to the outer skirt; and while the lid is disposed on the container such that the lid is disposed in a locked condition closing the container: the upper rim of the container is disposed within the container rim-receiving space; the inwardly projecting ridge is disposed below the container lip and the plurality of lid locking members are disposed relative to the container lip such that a distal end of each one of the plurality of lid locking members, independently, is disposed within the lid-locking receiving space defined by the container lip.

In accordance with another aspect of the present disclosure, there is provided a container system, comprising: a container having a bottom wall; a container wall element extending from a periphery of the bottom wall to an upper rim and defining an open, interior container space, the upper rim including an outwardly projecting container lip defining a lid-locking receiving space between an outer surface of the container wall element and an undersurface of the container lip; and a lid, the lid comprising a central panel; a peripheral member extending from a periphery of the central panel, the peripheral member having: an inner wall member extending from the periphery of the central member; an outer skirt defining an outer perimeter of the lid, wherein the outer skirt is disposed in spaced apart relationship from the inner wall member such that a container rim-receiving space is defined between the inner wall member and the outer skirt that is configured for receiving the upper rim of the container; a plurality of lid locking members defined within the outer skirt and disposed at spaced apart intervals about the outer skirt, each one of the plurality of lid locking members, independently, extending from the outer skirt to a distal end that is free from connection to the outer skirt; and an inwardly projecting ridge extending from an inner surface of the outer skirt and extending about the inner circumference of the outer skirt such that an inwardly projecting ridge portion is disposed between adjacent ones of the plurality of lid locking members. The plurality of lid locking members each, independently, configured to flex, relative to the outer skirt; and while the lid is disposed on the container such that the lid is disposed in a locked condition closing the container: the upper rim of the container is disposed within the container rim-receiving space; the inwardly projecting ridge is disposed below the container lip and the plurality of lid locking members are disposed relative to the container lip such that the distal end of each of the plurality of lid locking members is disposed within the lid-locking receiving space defined by the container lip.

BRIEF DESCRIPTION OF THE DRAWINGS

Reference will now be made, by way of example, to the accompanying drawings which show example embodiments of the present application, and in which.

Figure 1:
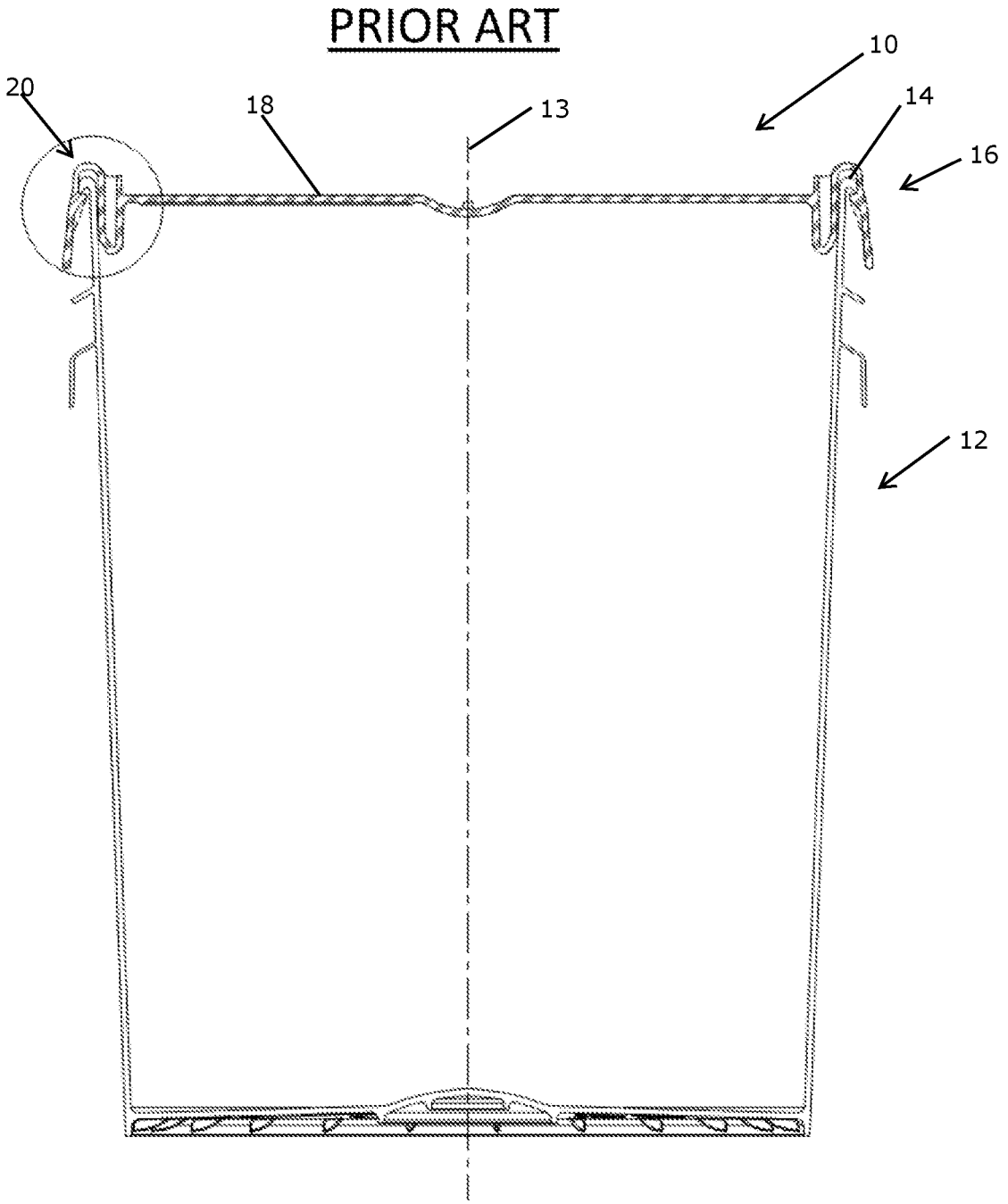
FIG. 1 is a longitudinal, cross-sectional view of a conventional container assembly including a container and lid, according to the prior art.

Similar reference numerals may have been used in different figures to denote similar components. As well, it should be noted that the figures are merely examples and no limitations on the scope of the present disclosure are intended thereby. Further, it will be understood that the figures are, generally, not drawn to scale, but are drafted for the purposes of convenience and clarity in illustrating various aspects of the disclosure.

DESCRIPTION OF EXAMPLE EMBODIMENTS

Figure 2:
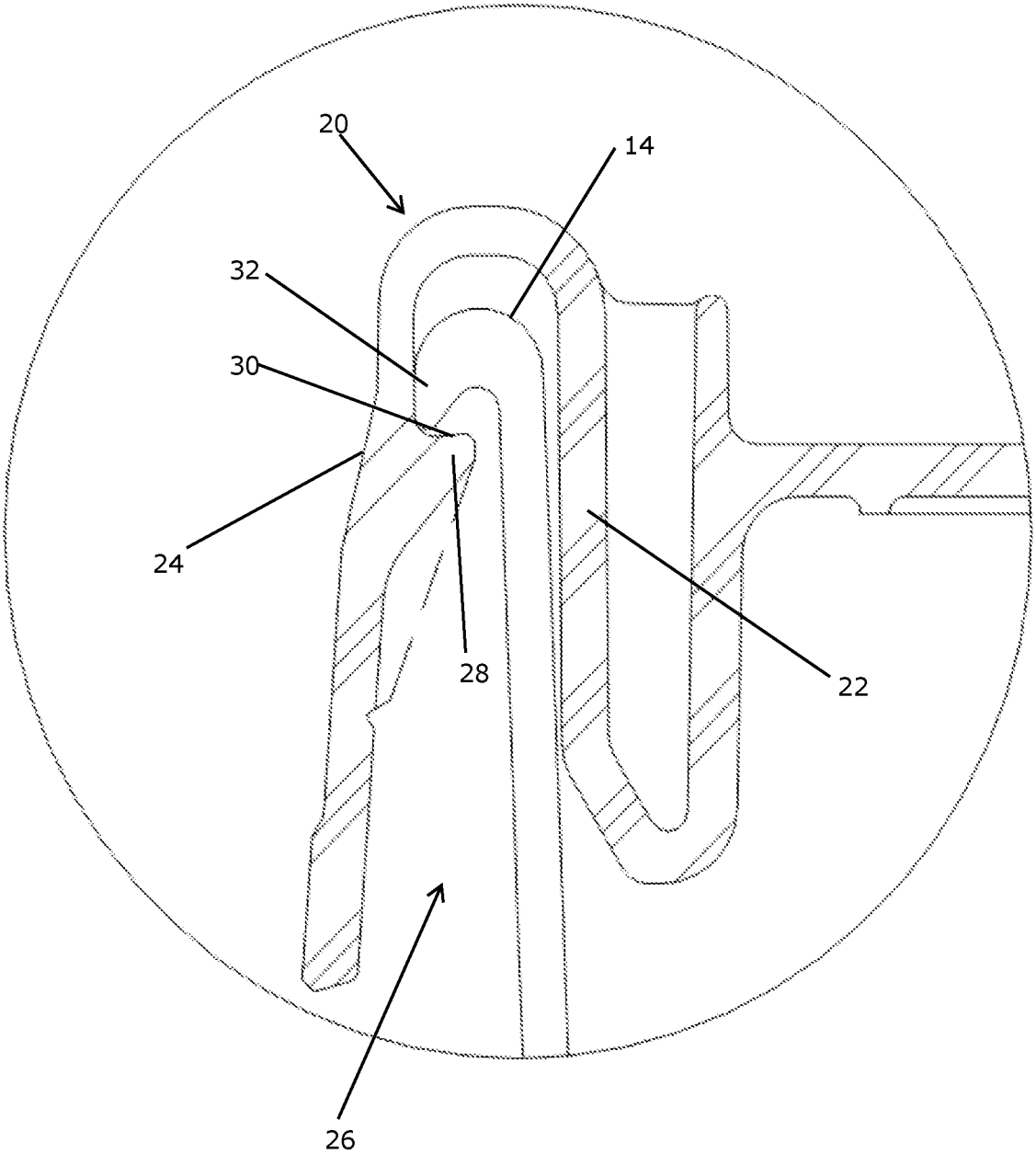
FIG. 2 is a detail view of the encircled area of the prior art container assembly of FIG. 1 illustrating the interlock between a conventional the lid and the corresponding, conventional container.

With reference now to FIGS. 1-2, there is shown a conventional container assembly 10, according to the prior art. As shown, the container assembly 10 includes a container, or pail, 12 having an upper rim 14 that is configured for cooperating with a conventional lid 16. The lid 16 has a central panel 18 configured for closing an open top end of the container 12, and a peripheral member 20 that is configured for engaging the upper rim 14 of the container 12. The peripheral member 20 has an inner wall portion 22 and an outer skirt 24, the inner wall portion 22 and the outer skirt 24 defining an annular receiving space 26 configured for receiving the upper rim 14 of the container 12 when the lid 16 is disposed on the container 12. Conventional, prior art lids 16 of the type shown in FIGS. 1 and 2, includes a protruding ridge 28 on the inner surface of the outer skirt 24 that extends continuously about the inner circumference of the outer skirt 24. The ridge 28 defines an engaging surface 30 that extends generally perpendicular to the central longitudinal axis 13 of the container assembly 10. Accordingly, as shown in FIG. 2, once the lid 16 is disposed on the container 12, the engaging surface 30 is disposed generally underneath an outwardly protruding lip 32 defined by the upper rim 14 of the container 12.

While disposition of the ridge 28 underneath the outwardly protruding lip 32 of the container 12, while the lid 16 is engaged on the container 12 in the closed condition, is intended to provide a secure interlock between the lid 16 and the container 12, it has been found that the ridge 28 can easily deform and slip-out from underneath the lip 32 around the upper rim 14 of the container 12 upon application of upwards forces on the outer skirt 24 of the lid 16 thereby allowing the lid 16 to more easily disengage from the upper rim 14 of the container 12. It has also been found that the ridge 28 of the conventional-style lid 16 can easily deform and slip-out from underneath the lip 32 in response to forces applied to the central panel 18 of the lid 16 by the contents of container 12 should the container assembly 10 be dropped. In instances where the contents of the closed container assembly 10 is a liquid, dropping of the container assembly 10 can result in hydraulic forces being applied against the inner surface of the central panel of the closed lid 16 which forces can cause the ridge 28 to deform under the lip 32 causing the lid 16 to disengage from the container 12.

Heavy duty, high performance container assemblies that include a container and a lid are often used for containing and transporting large volumes of liquids and are required to meet industry standards to ensure leakage at the interface between the lid and the container is prevented, as well as to ensure that the lid is not easily released from the container should the container assembly be mishandled or dropped. In this respect, secure engagement and interlock between the lid and the container is required to ensure that industry standards are met, especially when the container assembly is used for containing toxic and/or hazardous materials.

Accordingly, container lids that can provide a more secure interlock between the lid and the container to prevent leakage and/or accidental or unintentional disengagement of the lid from the container are desirable. Additionally, container lids that provide a robust interlock between the lid and container and that can withstand internal forces being applied to the inner surface of the closed lid, via the contents of the container, are desirable.

Figure 3:
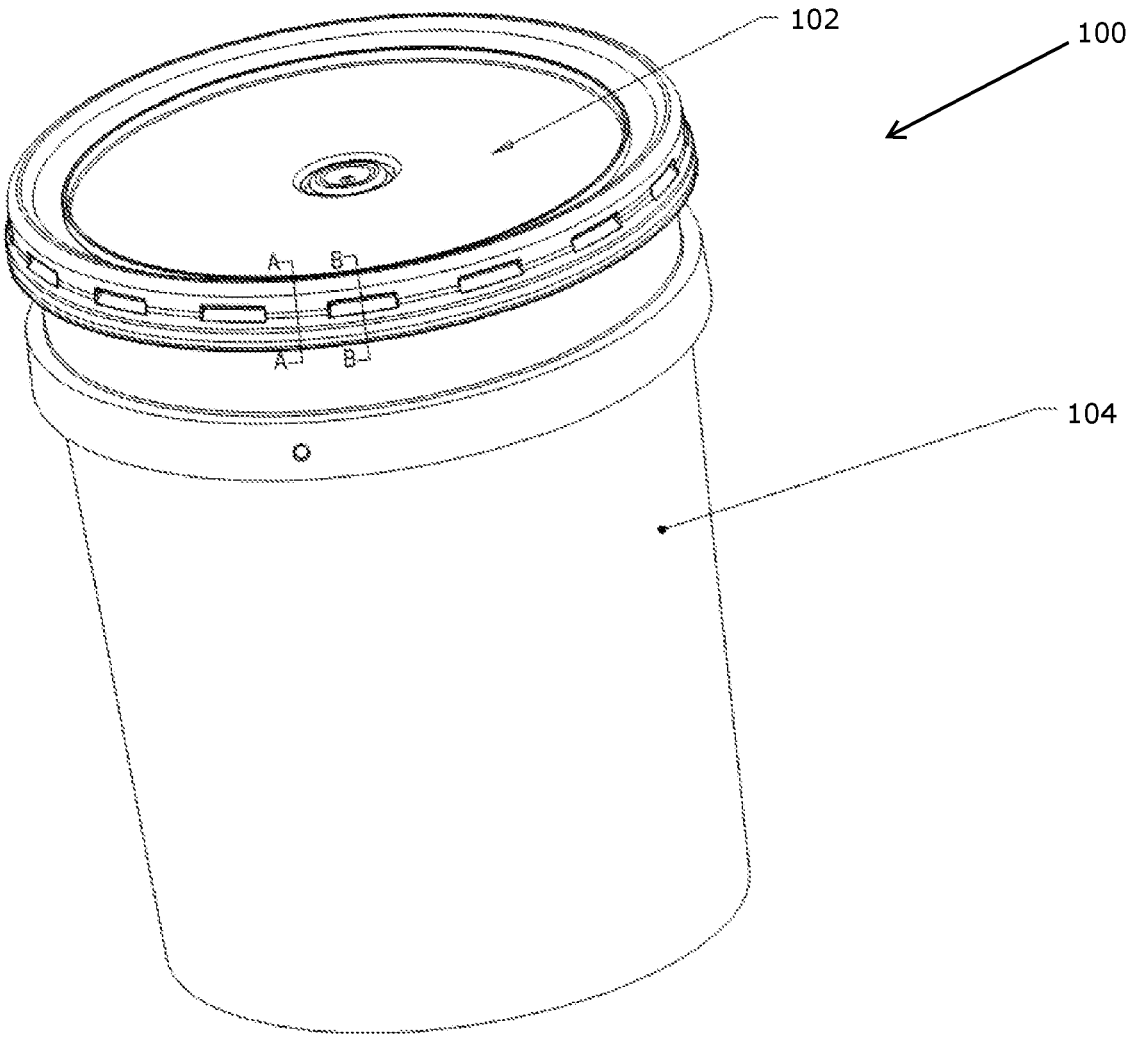
FIG. 3 is a perspective view of a container assembly incorporating a lid according to an example embodiment of the present disclosure.

Referring now to FIG. 3, there is shown a container assembly 100 incorporating a lid 102 according to an example embodiment of the present disclosure. The lid 102 is configured for use with any conventional container or pail. In some embodiments, for example, the lid 102 is configured for use with conventional containers or pails that are particularly suited for heavy duty applications. In some embodiments, for example, the lid 102 is configured for use with a container or pail that is specifically configured to cooperate with the lid 102 such that the container assembly 100 is specifically suited to a particular application.

In some embodiments, for example, the lid 102 and the container 104 are each, independently, comprised of a thermoplastic material. In some embodiments, for example, the lid 102 and the container 104 are each, independently, of unitary, one-piece construction. In some embodiments, for example, the lid 102 and the container 104 are each, independently, formed via injection molding. In some embodiments, for example, the lid 102 is configured to include and/or accommodate a pouring spout and/or vent inserts (not shown) in accordance with principles known in the art.

Figure 4:
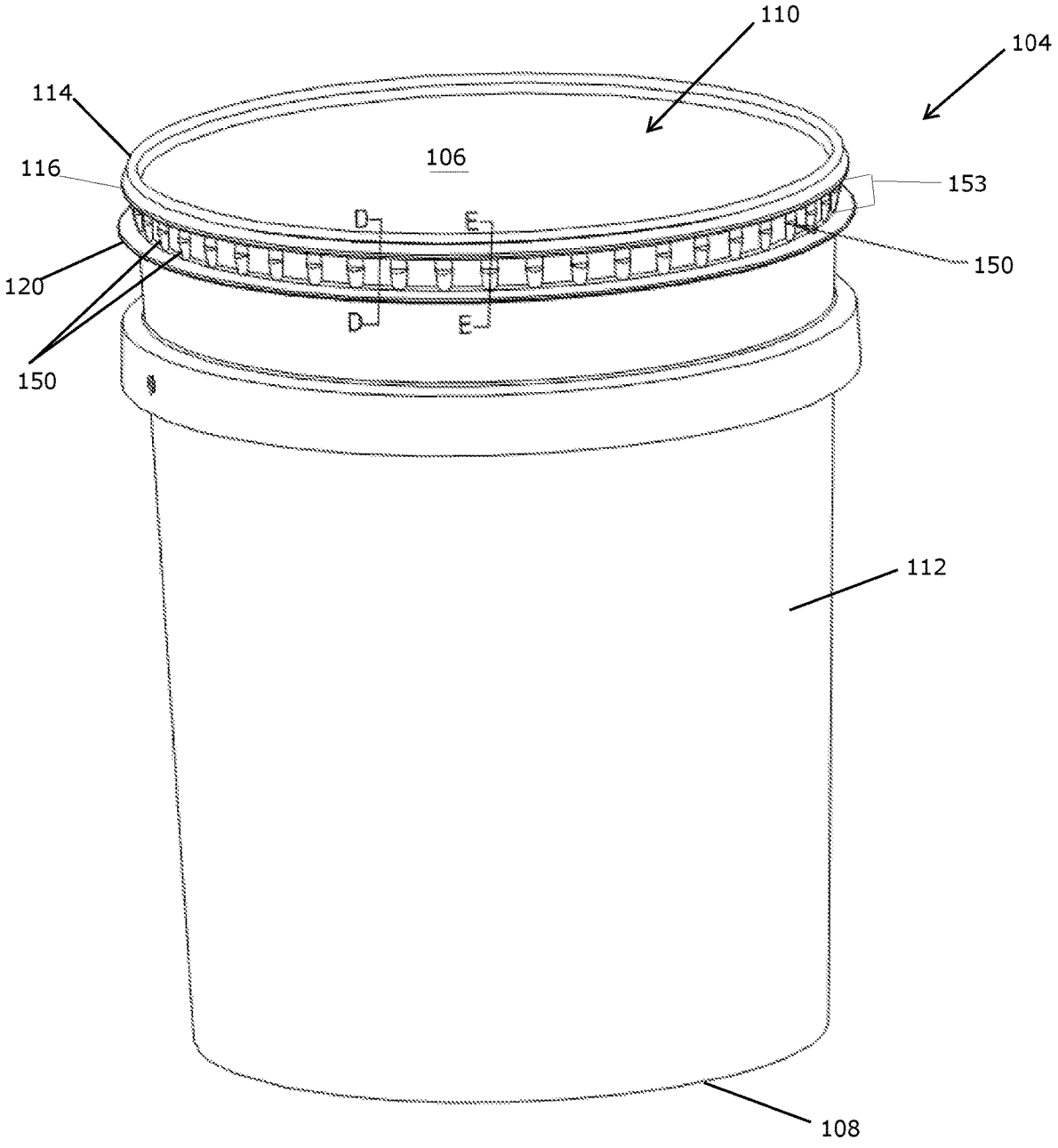
FIG. 4 is a perspective front view of an example embodiment of the container of the container assembly of FIG. 3.
Figure 5:
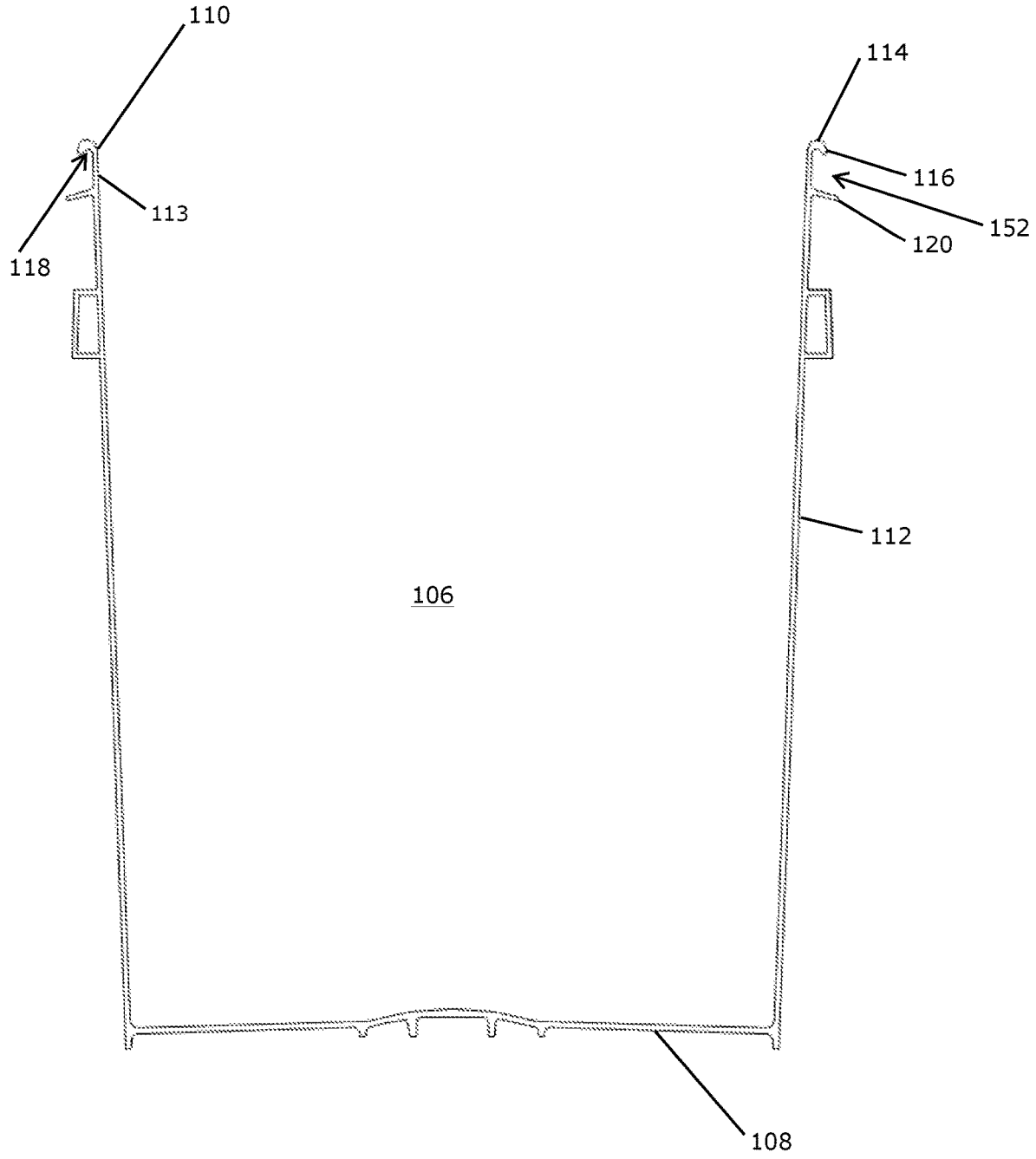
FIG. 5 is a longitudinal, cross-sectional view of the container of FIG. 2 taken through section line D-D illustrated in FIG. 4.
Figure 6:
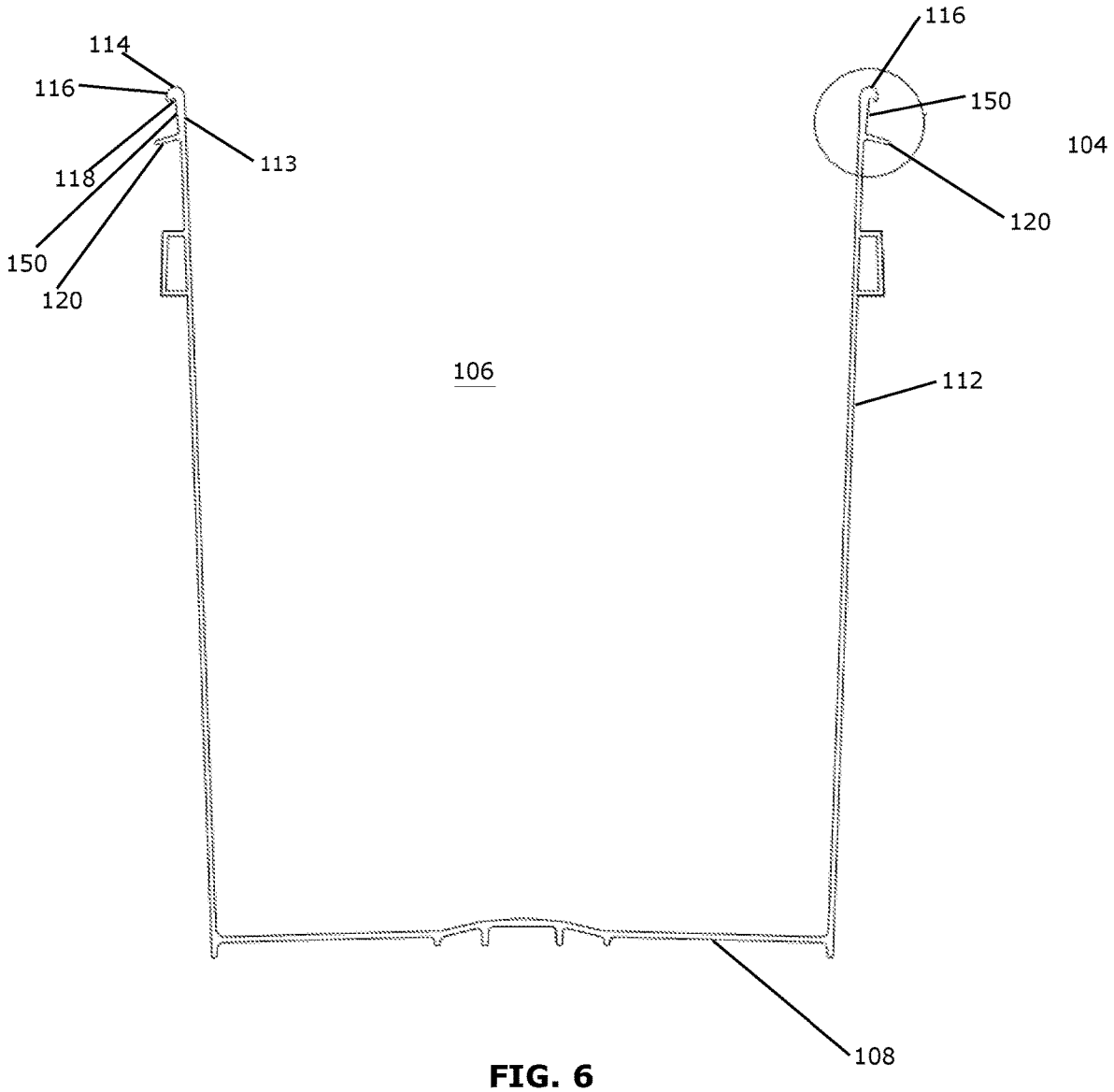
FIG. 6 is a longitudinal, cross-sectional view of the container of FIG. 2 taken through section line E-E illustrated in FIG. 4.

In some embodiments, for example, the container assembly 100 includes a container 104 having a similar configuration to the container 12 used in the conventional container assembly 10 described above in connection with FIGS. 1-2. More specifically, as shown in FIGS. 4-6, in some embodiments, for example, the container 104 defines an open interior container space 106 and has a closed, bottom or base end 108 and an open, top end 110 that provides access to the open interior container space 106. An upwardly extending tubular wall element 112 extends from the perimeter of the bottom wall that defines the base end 108 of the container 104 to the open, top end 110 of the container 104. The upwardly extending tubular wall element 112 terminates at an upper rim 114, the upper rim 114 defining the perimeter of the open, top end 110 of the container 104. The upper rim 114 of the container 104 includes an outwardly extending container lip 116 that extends about the perimeter of the open end 110 of the container 104. As shown in FIGS. 5 and 6, the outwardly extending lip 116 extends both outwardly and downwardly away from the open, top end 110 of the container 104 such that a lid-locking recess or lid-locking receiving space 118 is defined between a portion of the outer surface of the upwardly extending tubular wall element 112 and an undersurface 117 of the container lip 116, the lid-locking receiving space 118 extending continuously about the perimeter of the open end 110 of the container 104. In some embodiments, for example, the lid-locking receiving space 118 is an annular channel that extends about the perimeter of the container 104 between a portion of the outer surface of upwardly extending wall element 112 and an undersurface 117 of the container lip 116. In some embodiments, for example, the lid-locking receiving space 118 is a trough region that extends about the perimeter of the container 104 between a portion of the outer surface of upwardly extending wall element 112 and an undersurface 117 of the container lip 116.

In some embodiments, for example, the container 104 includes an outwardly protruding flange 120 that is spaced downwardly away from the container lip 116 defined at the upper rim 114 of the container, as measured along a central longitudinal axis of the container 104, while the container 104 is in an upright orientation. In some embodiments, for example, the flange 120 extends radially outwardly away from the outer surface 111 of the container wall element 112, relative to the central, longitudinal axis of the container 104. In some embodiments, for example, the flange 120 extends outwardly away from the outer surface of the container wall element 112 at a downwards angle relative to a horizontal plane that extends through the central longitudinal axis of the container 104. In some embodiments, for example, the flange 120 adds reinforcement to the upwardly extending tubular wall element 112 and to the overall structure of the container 104. In some embodiments, for example, the flange 120 serves as a tamper resistant band for further enhancing the robust interlock between the lid 102 and the container 104. In particular, in some embodiments, the flange 120 is configured such that while the lid 102 is securely engaged on the container 104 with effect that the container 104 is disposed in a closed condition, the flange 120 impedes access to the bottom edge or underside of the outer perimeter of the lid 102 making removal of the lid 102 from the container 104, via gripping of the bottom edge of the lid 102 or via wedging of a tool underneath the bottom edge or underside of the lid 102, difficult.

Referring now to FIGS. 7-14, example embodiments of the lid 102 for use in a container assembly 100 and configured for locking engagement with a corresponding container 104, are described.

In some embodiments, for example, the lid 102 is configured for cooperating with the above-described container 104 such that when the lid 102 is disposed on the open end 110 of the container 104, the lid 102 engages the container 104, thereby enclosing the open interior space 106 with effect that the container 104 is disposed in a closed condition. While the lid 102 is disposed on the container 104, the lid 102 engages the upper rim 114 of the container 103 such that removal of the lid 102 from the container 104 is resisted. More specifically, in some embodiments, for example, the lid 102 is configured for cooperating with the upper rim 114 of the container 104 such that, when the lid 102 is disposed on the open end 110 of the container 104, the lid 102 engages the upper rim 114 of the container 104 with effect that a robust interlock between the lid 102 and the container 104 is provided. The robust interlock established between the lid 102 and the container 104 is such that removal of the lid 102 from the container 104 is resisted. In some embodiments, for example, the robust interlock established between the lid 102 and the container 104 is such that removal of the lid 102 from the container 104 is prevented without the use of additional tooling. In some embodiments, for example, the engagement and robust interlock provided between the lid 102 and the container 104 is such that the lid 102 remains engaged with the upper rim 114 of the container 104 and secured in position relative to the container 104 such that the container assembly 100 remains disposed in a closed condition, in response to dropping of the container assembly 100. In some embodiments the robust interlock established between the lid 102 and the container 104 provides a sealing effect such that leakage of the contents of the container 104 at the interface between the container 104 and the lid 102 is prevented. In some embodiments, for example, the lid 102 is configured such that the engagement between the lid 102 and the upper rim 114 of the container 104 is with effect that the lid 102 remains secured in position, relative to the container 104, in response to application of hydraulic forces that are applied to the undersurface of the lid 102, by liquid contents of the container 104, in response to mishandling and/or dropping of the closed container assembly 100. In particular, in some embodiments, for example, the lid 102 is configured such that the engagement between the lid 102 and the container 104, when the lid 102 is disposed on the container such that the container assembly 100 is disposed in a closed condition, is with effect that the lid 102 remains disposed on the container 104 and the container assembly 100 remains disposed in the closed condition in instances where the closed container assembly 100, with liquid contents disposed therein, is dropped from a height between a minimum of 0.5 m to a maximum of 3 m. In some embodiments, for example, the lid 102 is configured such that the engagement of the lid 102 and the upper rim 114 of the container 104 is with effect that the lid 102 remains secured and engaged in position, relative to the container 104, in response to dropping of the closed container assembly 100 from a height between a minimum of 0.5 m to a maximum of 3 m while the container assembly 100 is in any one of the following alternative orientations: horizontal, vertical or 45 degrees relative to vertical.

Figure 7:
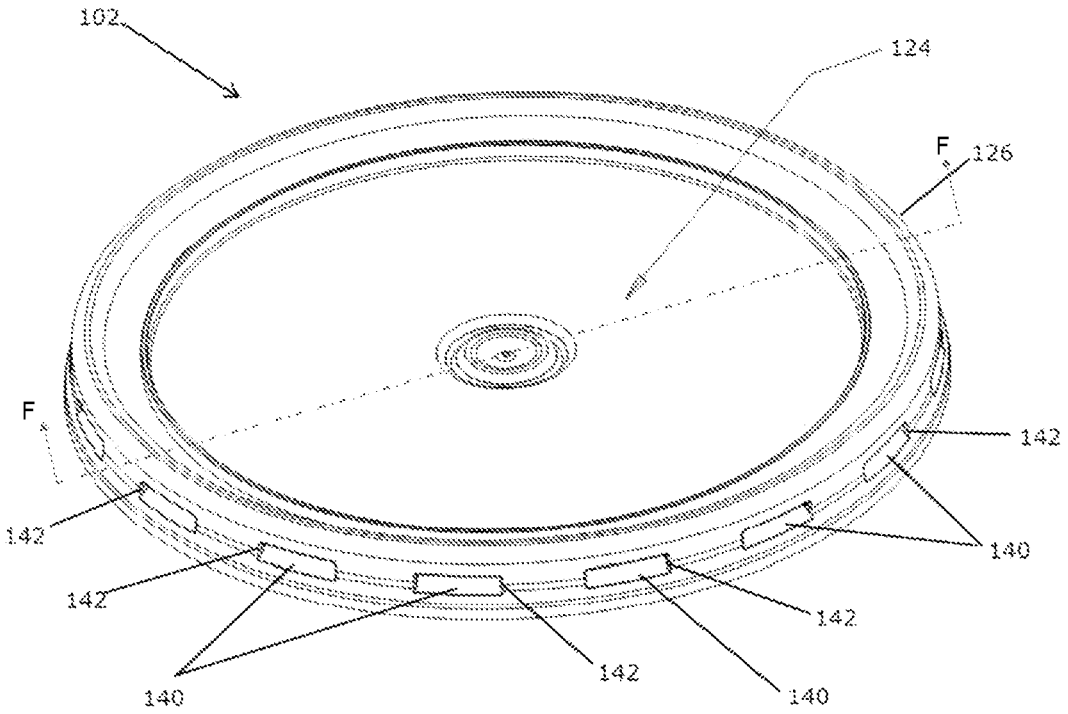
FIG. 7 is a top, perspective view of the lid of the container assembly of FIG. 3, according to an example embodiment of the present disclosure.
Figure 8:
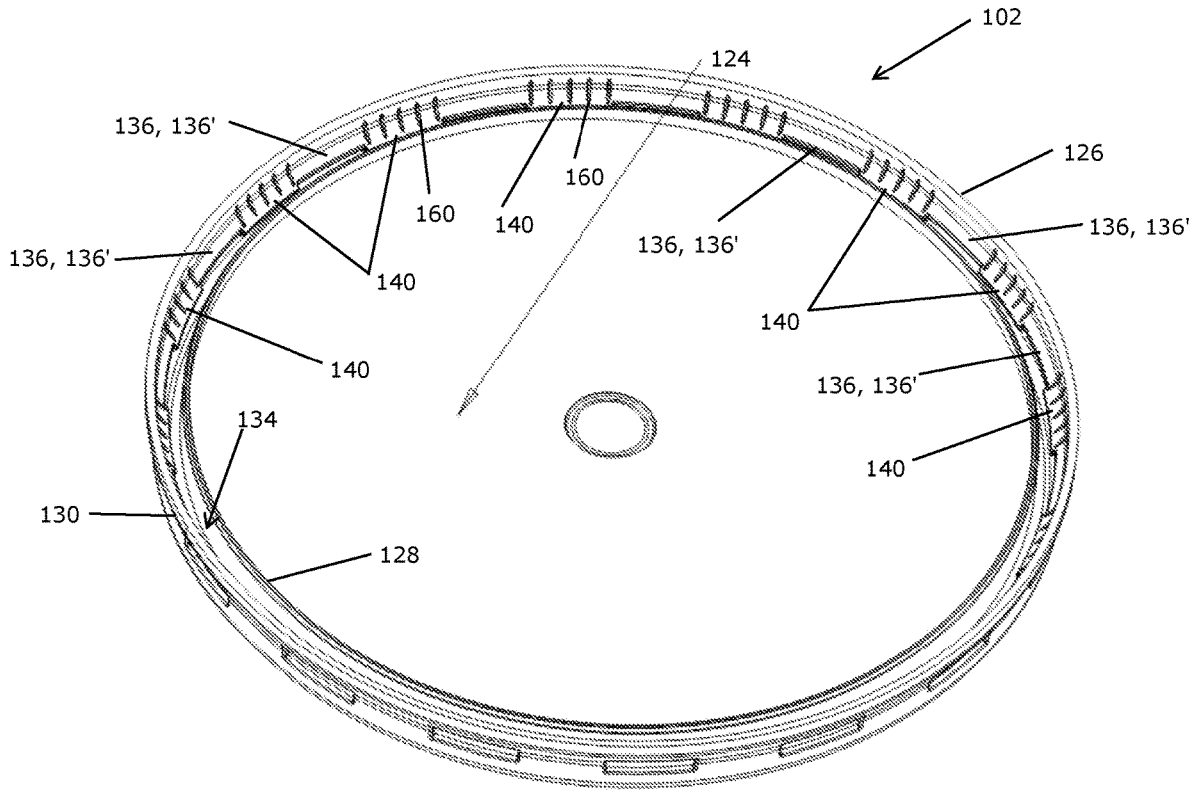
FIG. 8 is a bottom, perspective view of the underside of the lid FIG. 7.

Referring, in particular to FIGS. 7 and 8, the features of the lid 102 will be described in further detail. The lid 102 includes a central panel 124 that is configured for closing the open, top end 110 of the corresponding container 104 and a peripheral member 126 that is configured for engaging the upper rim 114 of the container 104. In the subject example embodiment, the lid 102 is circular and corresponds in shape to the corresponding container 104. In other embodiments, however, it will be understood that the lid 102 may be rectangular, square, elliptical, parallelogram, or any other suitable shape for a lid for use with a corresponding container. While the subject example embodiment is described in connection with a circular lid 102, it will be understood that the lid 102 and the corresponding container 104 are not necessarily limited to circular embodiments.

Figure 11:
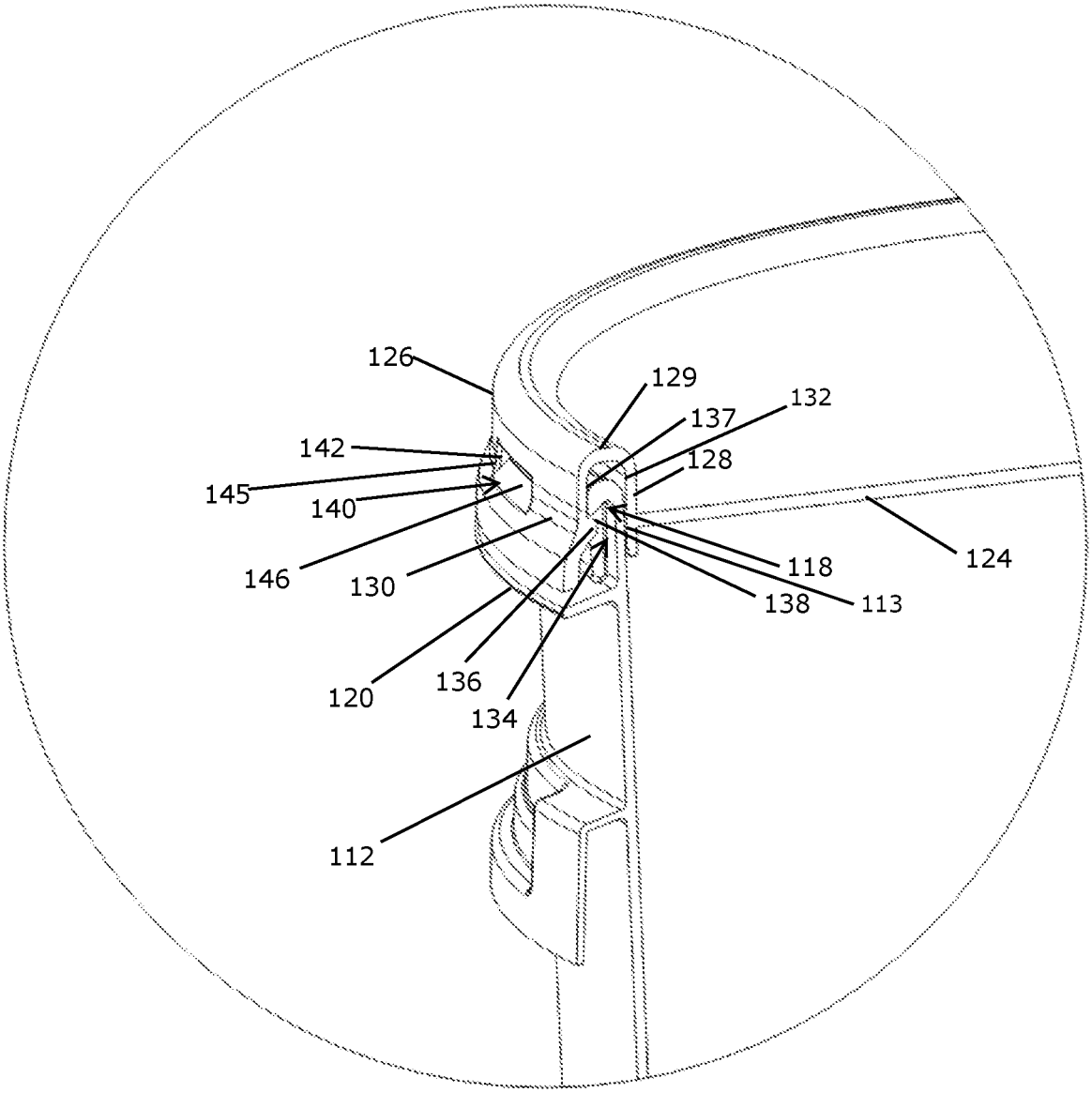
FIG. 11 is a detail, sectional view of the container assembly, as taken along section line A-A in FIG. 3, illustrating the interlock between lid with the container.

With reference also to FIGS. 11-14, the peripheral member 126 of the lid 102 includes an inner wall member 128 that extends from the periphery of the central panel 124 of the lid 102 and an outer skirt 130. The inner wall member 128 has an outer surface 132 that is configured for contact engagement or face-to-face disposition with a portion of an inner surface 113 the container wall element 112 proximal the upper rim 114. The outer skirt 130 is configured to overlie and engage at least a portion of the outer surface of the container wall element 112. As shown in FIG. 11, the outer skirt 130 is interconnected to and spaced apart from the inner wall member 128 by an upper, interconnecting web portion 129 of the peripheral member 126. Accordingly, the inner wall member 128, the outer skirt 130 and the upper web portion 129 of the peripheral member 126 are cooperatively configured such that, together, they define a container rim-receiving space 134. In some embodiments, for example, the container rim-receiving space 134 is an annular channel disposed between the outer surface 132 of the inner wall 128 of the peripheral member 126 and the interior surface of the outer skirt 130 that is configured for receiving the upper rim 114 portion of the container 104 as the lid 102 is disposed on the container 104 such that the container assembly 100 is disposed in a closed condition.

Referring now in particular to FIGS. 7-10, the lid 102 includes a plurality of lid locking members 140 disposed within the outer skirt 130 of the peripheral member 126. The plurality of lid locking members 140 are disposed within the outer skirt 130 such that the plurality of lid locking members 140 are disposed at spaced apart intervals about the perimeter of the lid 102. The plurality of lid locking members 140 are disposed within the outer skirt 130 such that each of the plurality of lid locking members 140 is configured to extend into the container rim-receiving space 134. Accordingly, each of the plurality of lid locking members 140 extends inwardly into the container rim-receiving space 134 relative to the inner or interior surface of the outer skirt 130 of the peripheral member 126 (see for instance FIG. 9).

In some embodiments, for example, the plurality of lid locking members 140 are spaced apart equidistantly around the perimeter of the outer skirt 130. In some embodiments, for example, the lid 102 includes at least two lid locking members 140. In some embodiments, for example, the lid 102 includes a maximum of 48 lid locking members 140. Accordingly, it will be understood that the number of lid locking members 140 provided on the lid 102 will depend on the particular size and shape of the lid 102 and the particular container 104 for which the lid 102 corresponds. The total number of lid locking members 140 provided on the lid 102 may also vary depending on the particular application or use for the lid 102 and the overall container assembly 100.

Figure 9:
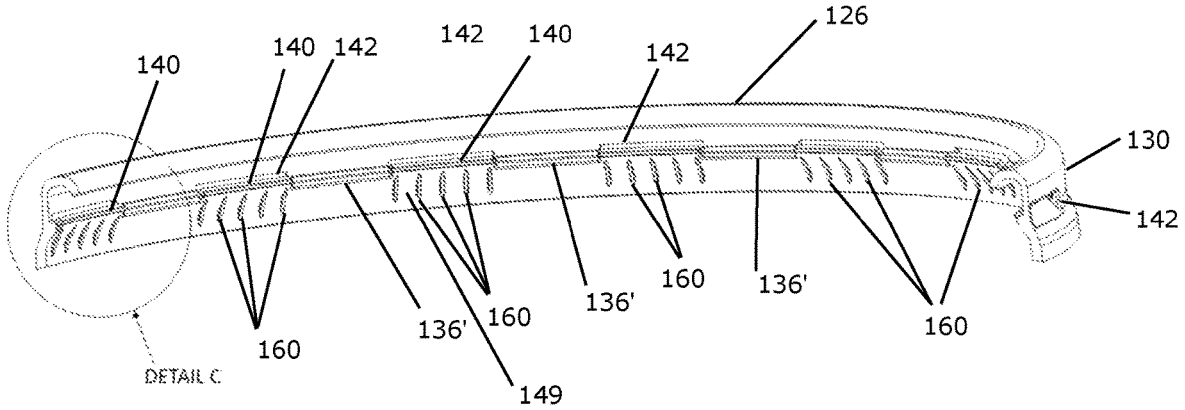
FIG. 9 is a perspective, sectional view through the lid of FIG. 7, taken along section line F-F, illustrated in FIG. 7, with the central panel of the lid removed for ease of illustration.
Figure 10:
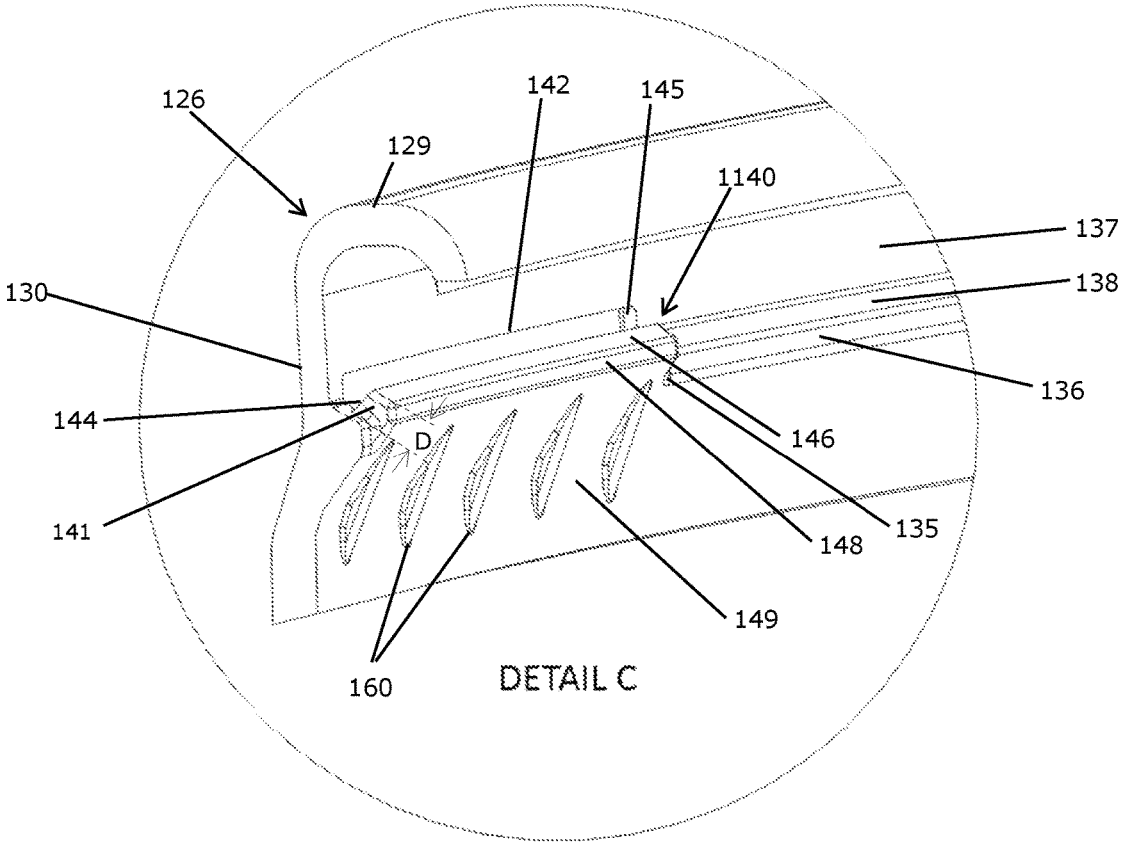
FIG. 10 is a detail view of the encircled area "C" of FIG. 9.
Figure 10A:
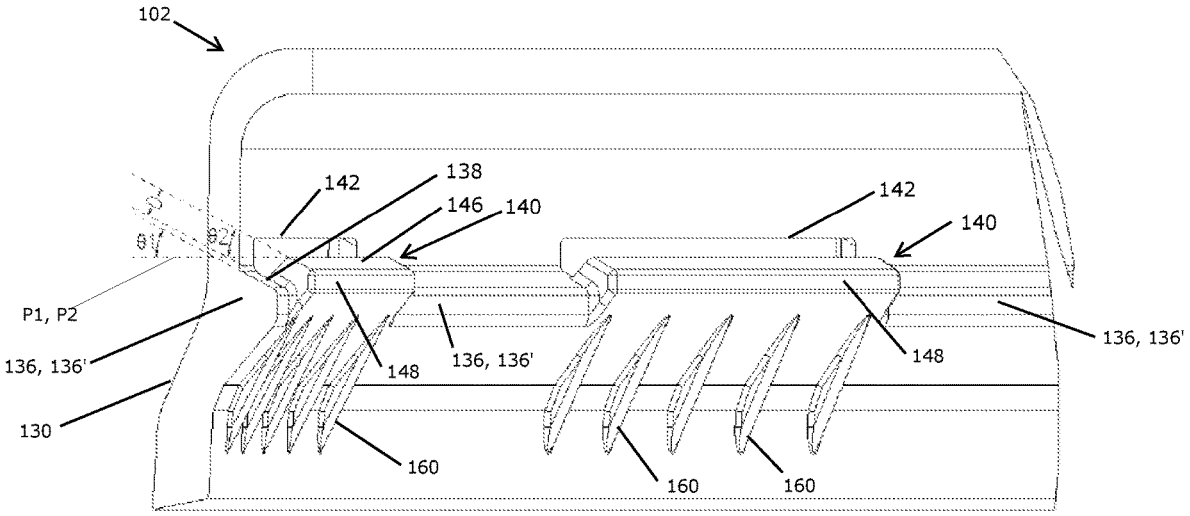
FIG. 10A is a similar view of the encircled area "C" as shown in FIG. 10 further illustrating the angles of the lid locking member end surface and the first surface of the inwardly projecting ridge of the lid.

Referring in particular to FIGS. 9 and 10, in some embodiments, for example, the lid 102 includes an inwardly projecting ridge 136 provided on the inner or interior surface of the outer skirt 130. The inwardly projecting ridge 136 projects inwardly from the inner or interior surface 137 of the outer skirt 130 into the container rim-receiving space 134 that is defined by the peripheral member 126 of the lid 102 between adjacent ones of the plurality of lid locking members 140. Therefore, in the subject example embodiment, it will be understood that the inwardly projecting ridge 136 of lid 102 is comprised of a plurality of inwardly projecting ridge portions 136' that each, independently, span the distance between adjacent ones of the plurality of spaced apart lid locking members 140. Accordingly, the inwardly projecting ridge 136 would otherwise extend continuously about the interior surface 137 of the outer skirt 130 if not for the plurality of the lid locking members 140 that interrupt the inwardly projecting ridge 136 at the spaced apart intervals about the perimeter of the interior surface 137 of the outer skirt 130. In example embodiments wherein the lid 102 is circular, it will be understood that the inwardly projecting ridge 136 would otherwise be a continuous loop extending about the interior surface 137 of the outer skirt 130 if not for the plurality of the lid locking members 140 that interrupt the inwardly projecting ridge 136 at the spaced apart intervals about the inner circumference defined by the interior surface 137 of the outer skirt 130.

Figure 16:
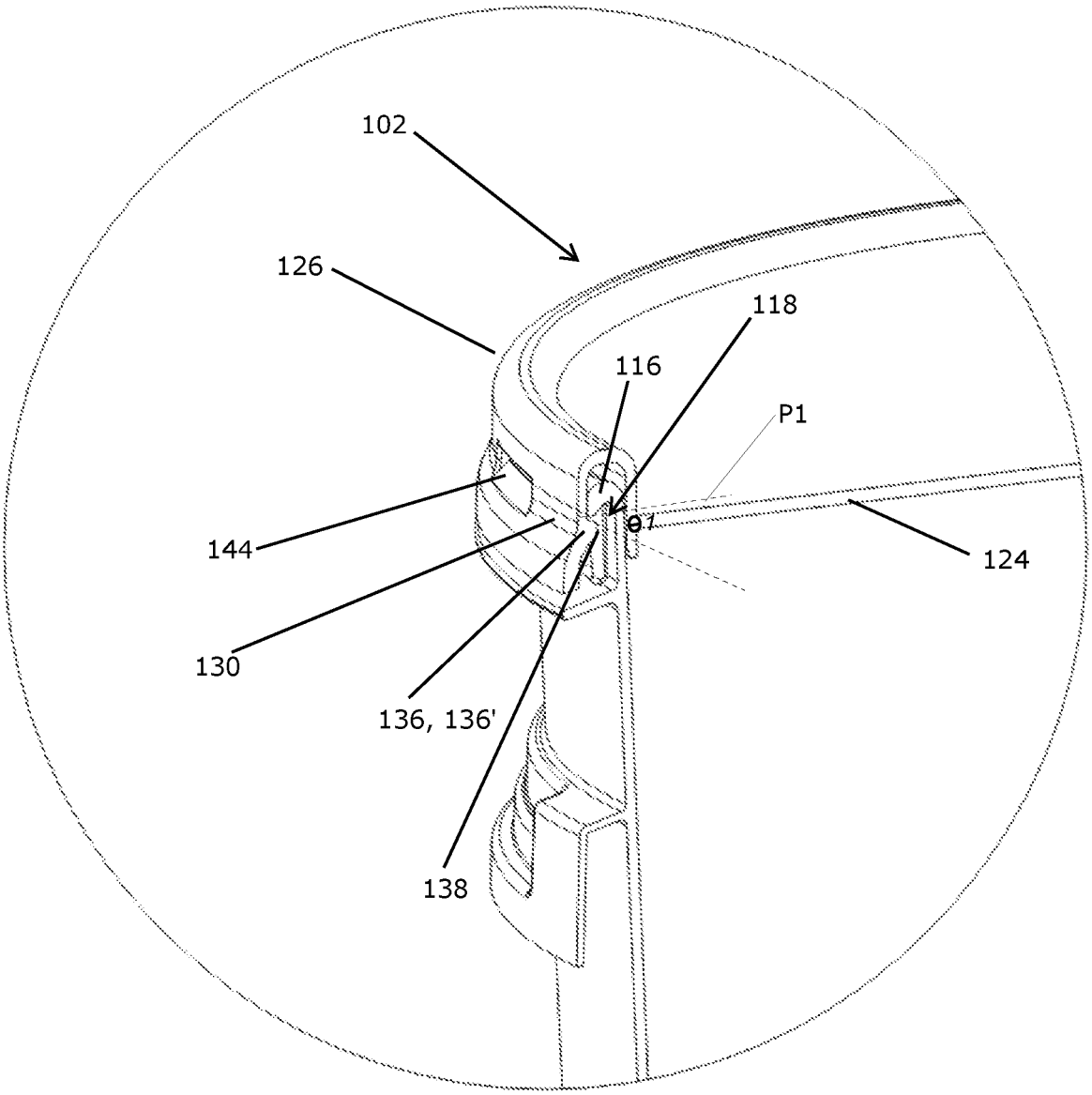
FIG. 16 is a similar to the detail, sectional view of the container assembly as shown in FIG. 11 and further illustrates the angled surface defined by the inwardly projecting ridge portions of the lid.
Figure 17:
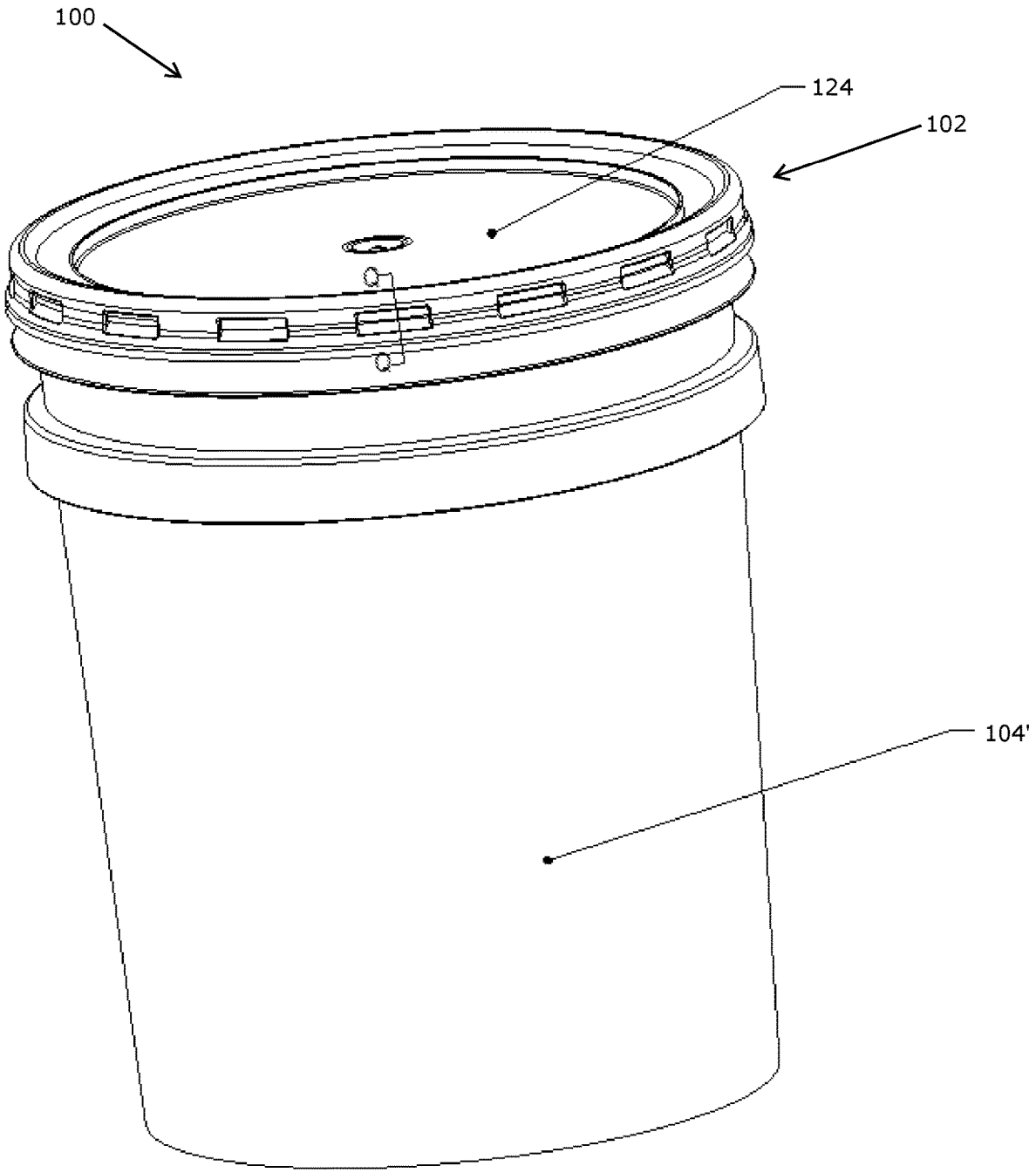
FIG. 17 is a perspective view of a container assembly according to another example embodiment of the present disclosure.
Figure 18:
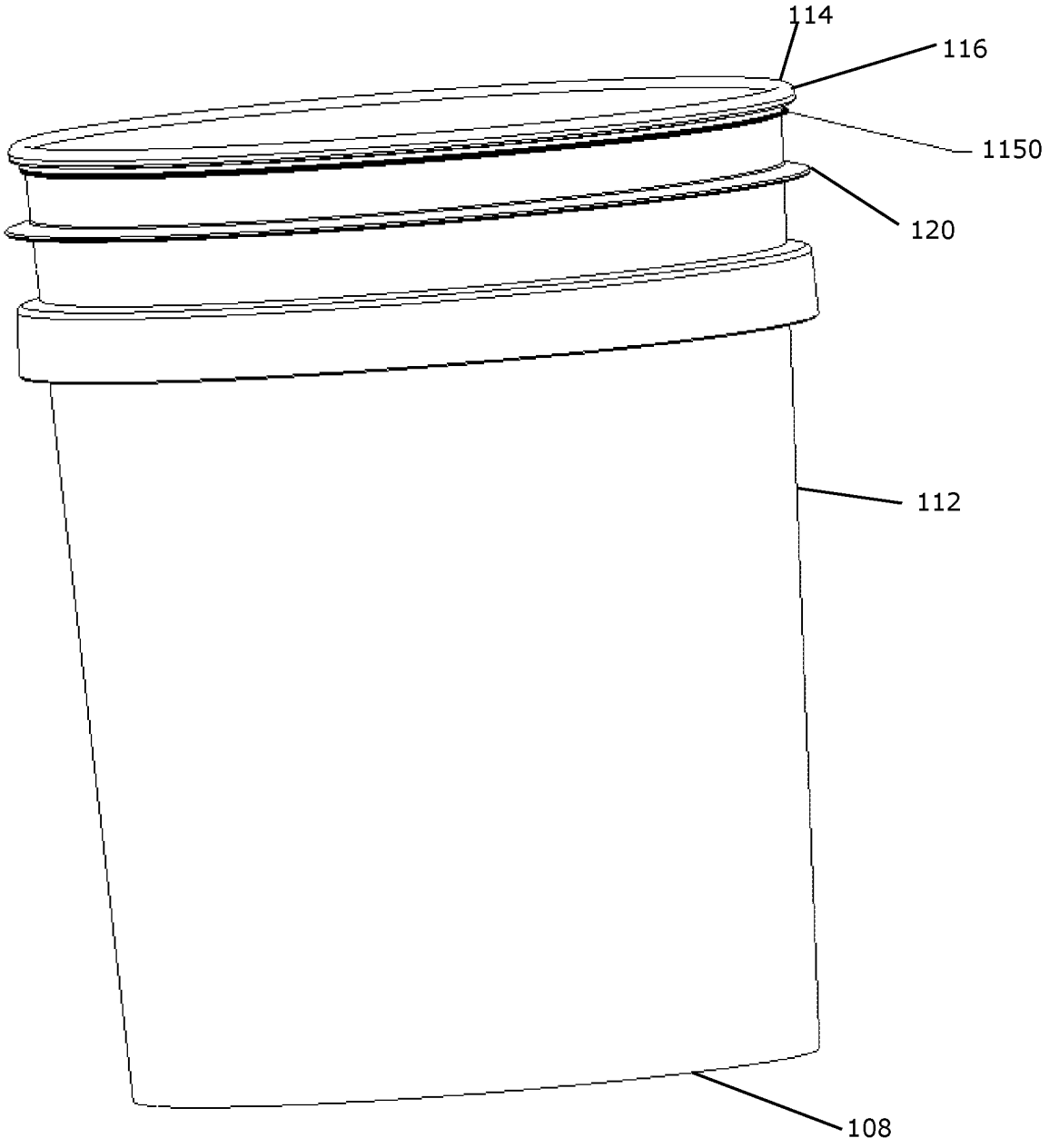
FIG. 18 is a perspective view of the container of the container assembly of FIG. 17 that is configured for cooperating with the lid of FIG. 7.

The inwardly projecting ridge 136 is configured such that each of the inwardly projecting ridge portions 136' project into the container rim-receiving space 134 defined between the inner or interior surface 137 of the outer skirt 130 and the inner wall 128 of the peripheral member 126 of the lid 102. In some embodiments, for example, the ridge 136 (or each of the inwardly projecting ridge portions 136') projects inwardly into the container rim-receiving space 134 defined by the peripheral member 126 such that each of the inwardly projecting ridge portions 136' defines a first surface 138 that extends at a downwards angle relative to the interior surface of the outer skirt 130. In this respect, in some embodiments, for example, the first surface 138 defined by each of the inwardly projecting ridge portions 136' extends into the container rim-receiving space 134 defined by the peripheral member 126 from the interior surface 137 of the outer skirt 130 at a downwards angle, θ1, as measured relative to a horizontal plane (P1) that extends through the outer skirt 130 of the peripheral member 126 (see for instance FIG. 16). In some embodiments, for example, the angle, θ1, as defined by the first surface 138 of each of the inwardly projecting ridge portions 136' is between a minimum of 0° and a maximum of 70°. Accordingly, in some embodiments, for example, the inwardly projecting ridge 136 is formed such that the first surface 138 of each of the inwardly projecting ridge portions 136' defines a negative undercut relative to the inner or interior surface 137 of the outer skirt 130. In other embodiments, for example, the inwardly projecting ridge 136 may be configured such that the first surface 138 of each of the inwardly projecting ridge portions 136' extends generally perpendicular, relative to the interior surface 137 of the outer skirt 130, or relative to a central axis of the lid 102 such that the first surface 138, as defined by the inwardly projecting ridge 136, or ridge portions 136', extends generally parallel to a horizontal plane (P1) that extends through the outer skirt 130. In instances where the lid 102 is formed via injection molding techniques, it will be understood that the angle, θ1, as defined by the first surface 138 of the inwardly projecting ridge 136, or inwardly projecting ridge portions 136', relative to a horizontal plane that extends through the outer skirt 130, is selected such that removal or de-molding of the lid 102 from the corresponding mold is facilitated.

With reference again to FIGS. 9 and 10, each of the plurality of lid locking members 140, independently, extends inwardly, relative to the outer skirt 130 and into the container rim-receiving space 134 defined by the peripheral member 126. In some embodiments, for example, each of the plurality of lid locking members 140 extends inwardly into the container rim-receiving space 134 at an upwards angle relative to the inner or interior surface 137 of the outer skirt 130 such that each of the plurality of lid locking members 140 extends upwardly beyond the adjacent inwardly projection ridge portions 136' in the container rim-receiving space 134. In this respect, each of the lid locking members 140, independently, has a distal end, or a container-engaging end 1140, that is configured for engaging the container lip 116 when the lid 102 is disposed on the container 104 such that the lid 102 is disposed in the locked position relative to the container 104 with effect that the container assembly 100 is disposed in the closed condition. In particular, disposition of the lid 102 on a corresponding container 104 is with effect that the plurality of lid locking members 140 are disposed relative to the container 104 such that the container-engaging end 1140 of each of the plurality of lid locking members 140 is disposed within the lid-locking receiving space 118, defined by the container lip 116, for effecting locking engagement of the lid 102 relative to the upper rim 114 of the container 104. Accordingly, disposition of the container-engaging end 1140 of each of the lid locking members 140 within the lid-locking receiving space 118 once the lid 102 is disposed on the open end of the container 104 is with effect that the container 104 is disposed in a closed condition wherein the lid 102 is securely engaged on the container 104 such that unintentional or accidental removal of the lid 102 from the container 104 is prevented.

As a result of the formation of the plurality of lid locking members 140 within the outer skirt 130 of the peripheral member 126, corresponding openings, or windows, 142 are formed in the outer skirt 130 as a result of the inward disposition and inward extension of each of the plurality of lid locking members 140, relative to the outer skirt 130. Openings 142 are visible from the outer surface of the outer skirt 130 (see for instance FIGS. 7 and 8). Each opening 142 formed in the outer skirt 130 corresponds to a respective one of the plurality of lid locking members 140.

The plurality of lid locking members 140 each have side edge surfaces 141 which side edge surfaces 141 extend beyond the inward projection of the adjacent inwardly projecting ridge portion 136'. In some embodiments, for example, the side edge surfaces 141 of each of the plurality of lid locking members 140 are free from connection to the corresponding side edges 135 of the inwardly projecting ridge portions 136'. Additionally, in some embodiments, the side edge surfaces 141 of the plurality of lid locking members 140 are free from connection to the corresponding side edges 145 of the corresponding window, or opening, 142 that is formed in the outer skirt 130. Accordingly, in such example embodiments, the lid locking members 140 are integrally connected to the outer skirt 130 along only a bottom end 143 with the lid locking members 140 being free to flex and move independently relative to the side edges 145 of the corresponding window, or opening 142 and independently from the side edges 135 of the adjacent inwardly projecting ridge portions 136'. In other embodiments, for example, the lid locking members 140 are integrally connected at their side edge surfaces 141 to the side edges 145 of the corresponding window, or opening 142 formed in the outer skirt 130 at the interface between the side edge surfaces 141 of the lid locking members 140 and the side edges 145 of the openings 142, as well as to the side edges 135 of the inwardly projecting ridge portions 136' disposed on either side of the corresponding lid locking member 140 at the interface between the side edge surfaces 141 of the lid locking members 140 and the side edges 135 of the adjacent inwardly projecting ridge portion 136'. In some embodiments, for example, the inwardly projecting ridge portions 136' provide lateral support to the adjacent lid-locking member 140 for preventing undue lateral deflection or distortion of the lid-locking member 140 in the lateral direction which could inadvertently un-hinge or unlock the lid-locking member 140 from the lid-locking receiving space 118 underneath the container lip 116.

The lid locking members 140 are each, independently, configured to flex relative to the outer skirt 130, and relative to the inwardly projecting ridge portions 136' that extend from the interior surface 137 of the outer skirt 130 on either side of a respective one of the plurality of lid locking members 140. The lid locking members 140 are each, independently, configured to flex relative to the outer skirt 130, and relative to the inwardly projecting ridge portions 136' in instances where the side edge surfaces 141 of the lid locking members 140 are free from connection to the outer skirt 130 and inwardly projecting ridge portions 136', as well as in instances where the side edge surface 141 of the lid locking members 140 are integrally connected to the outer skirt 130 and the inwardly projecting ridge portions 136'. In particular, the lid locking members 140 are each, independently, configured to flex relative to the outer skirt 130, and relative to the inwardly projecting ridge 136 (or ridge portions 136'), in response to the lid 102 being disposed on the corresponding container 104 such that the lid 102 becomes disposed in a locked condition relative to the container 104, the container 104 thereby being disposed in a closed condition. In this respect, as the lid 102 is disposed on the container 104 and is downwardly displaced relative to the upper rim 114 of the container 104, the upper rim 114 is received within the container rim-receiving space 134 defined by the peripheral member 126. Continued downwards displacement of the lid 102 relative to the container 104 brings each of the individual lid locking members 140 into contact with the outer surface of the container lip 116 with effect that the lid locking members 140 each, independently, deflect outwardly relative to their original disposition, relative to the outer skirt 130, as the lid 104 is further downwardly displaced relative to the outwardly extending lip 116 of the container 104. Once the lid locking members 140 pass or clear the outwardly extending container lip 116, the lid locking members 140 each, independently, return to their original disposition, relative to the outer skirt 130, with effect that at least a portion of each of the plurality of lid locking members 140 is disposed underneath the outwardly projecting lip 116 such that the distal, container-engaging end 1140 of each of the lid locking members 140 is disposed within the lid-locking receiving space 118 defined by the container lip 116. In some embodiments, for example, returning of the lid locking members 140 to their original disposition, relative to the outer skirt 130 upon clearing the outwardly extending container lip 116, is effected via a snap-back effect of the lid locking members 140. In some embodiments, for example, disposition of the lid 102 on the container 104 such that the container-engaging end 1140 of the lid locking members 140 is disposed within the lid-locking receiving space 118 is with effect that at least a portion of each of the lid locking members 104 is disposed in contact engagement with the undersurface 117 of the container lip 116. In some embodiments, for example, disposition of the lid 102 on the container 104 such that the container-engaging end 1140 of the lid locking members 140 is disposed within the lid-locking receiving space 118 is with effect that at least a portion of the outer surface 144 of each of the lid locking members 140 is disposed in contact engagement with the undersurface 117 of the container lip 116.

In some embodiments, for example, the lid locking members 140 are each, independently, configured to deflect or flex inwardly relative to the outer skirt 130, relative to their original disposition relative to the outer skirt 130. For example, in some embodiments, upwards forces applied to the lid 102 via the outer skirt 130 or via the central panel 124 (from forces applied against the lid 102 from within the container 104) are with effect that forces are applied to the lid locking members 140 as they impinge against the container lip 116 which forces effect inwards deflection of the lid locking members 140.

In some embodiments, for example, the lid 102 includes lid locking member support ribs 160 that are disposed along the inner surface of each of the lid locking members 140. The lid locking member support ribs 160 are configured to support the lid locking members 140. Accordingly, the lid locking member support ribs 160 provide additional stiffness and rigidity to the lid locking members 140 in order to prevent the lid locking members from easily being deformed to the extent that they would easily slip out from underneath the container lip 116.

With reference again to FIGS. 9 and 10, the lid locking members 140 will be described in further detail. As shown in FIG. 10, each lid locking member 140, extends further upwardly beyond the adjacent inwardly projecting ridge portions 136' disposed on either side of a respective lid locking member 140. Each lid locking member 140 also extends further inwardly into the container rim-receiving space 134, relative to the adjacent inwardly projecting ridge portions 136', by a distance, D, as illustrated for example in FIG. 10.

Each lid locking member 140, has an outer surface 144 that extends from the outer surface of the outer skirt 130 to a lid-locking member end surface 146. The lid-locking member end surface 146 is a downwardly angled surface that extends downwardly relative to a horizontal plane (P2) that intersects the terminal end edge of the outer surface 144 of the lid locking member 140 (see for instance FIG. 15). In some embodiments, for example, the lid-locking member end surface 146 extends downwardly, relative to the corresponding horizontal plane, at an angle, θ2, that corresponds to the angle of the first surface 138 defined by the each of the inwardly projecting ridge portions 136'. Accordingly, in some embodiments, for example, the lid-locking member end surface 146 defined by each of the plurality of lid locking members 140 and the first surface 138 defined by each of the inwardly projecting ridge portions 136' are disposed in parallel planes. Therefore, in some embodiments for example, the lid-locking member end surface 146 is disposed at an angle, θ2, relative to a horizontal plane that intersects the terminal end edge of the outer surface 144 of the lid locking member 140, of between a minimum of 0° and a maximum of 70° wherein the angle, θ2, is the same as the angle, θ1, of the first surface 138 of the inwardly projecting portions 136'. In other embodiments, for example, the lid-locking member end surface 146 as defined by each of the plurality of lid locking members 140 and the first surface 138 as defined by each of the inwardly projecting ridge portions 136' are disposed in respective planes such that the angle, θ2, of the lid locking member end surface 146 is different that the angle, θ1, as defined by the first surface of each of the inwardly projecting ridge portions 136'.

In some embodiments, for example, it has been found that having the lid-locking member end surface 146, as defined by each of the plurality of lid locking members 140, and the first surface 138, as defined by each of the inwardly projecting ridge portions 136', disposed at the same downward angle relative to a horizontal plane that intersects the lid locking member 140, facilitates manufacturing of the lid 102. In particular, in instances where the lid 102 is formed via injection molding techniques, it has been found that having both the first surface 138 of the inwardly projecting ridge portions 136' and the lid-locking member end surface 146 of the plurality of lid locking members 140 disposed in parallel planes that are disposed at the same downward angle, relative to a horizontal plane that intersects the lid locking member 140, facilitates ejection of the lid 102 from the corresponding mold. Specifically, by having the first surface 138, as defined by the inwardly projecting ridge portions 136', disposed at the same downwards angle as the lid locking member end surface 146 defined by each of the plurality of lid locking members 140, it has been found that as forces are applied to the periphery of the outer skirt 130, for example via a mold stripper ring during de-molding procedures, it has been found that the angled first surface 138 of the inwardly protruding ridge portions 136' takes the majority of the force applied to the lid 102, by the mold stripper ring, thereby preventing the plurality of lid locking members 140 being overly extended during the removal stage of the molding process, thereby facilitating manufacturing and reducing the likelihood of damage to the individual lid locking members 140.

Figure 12:
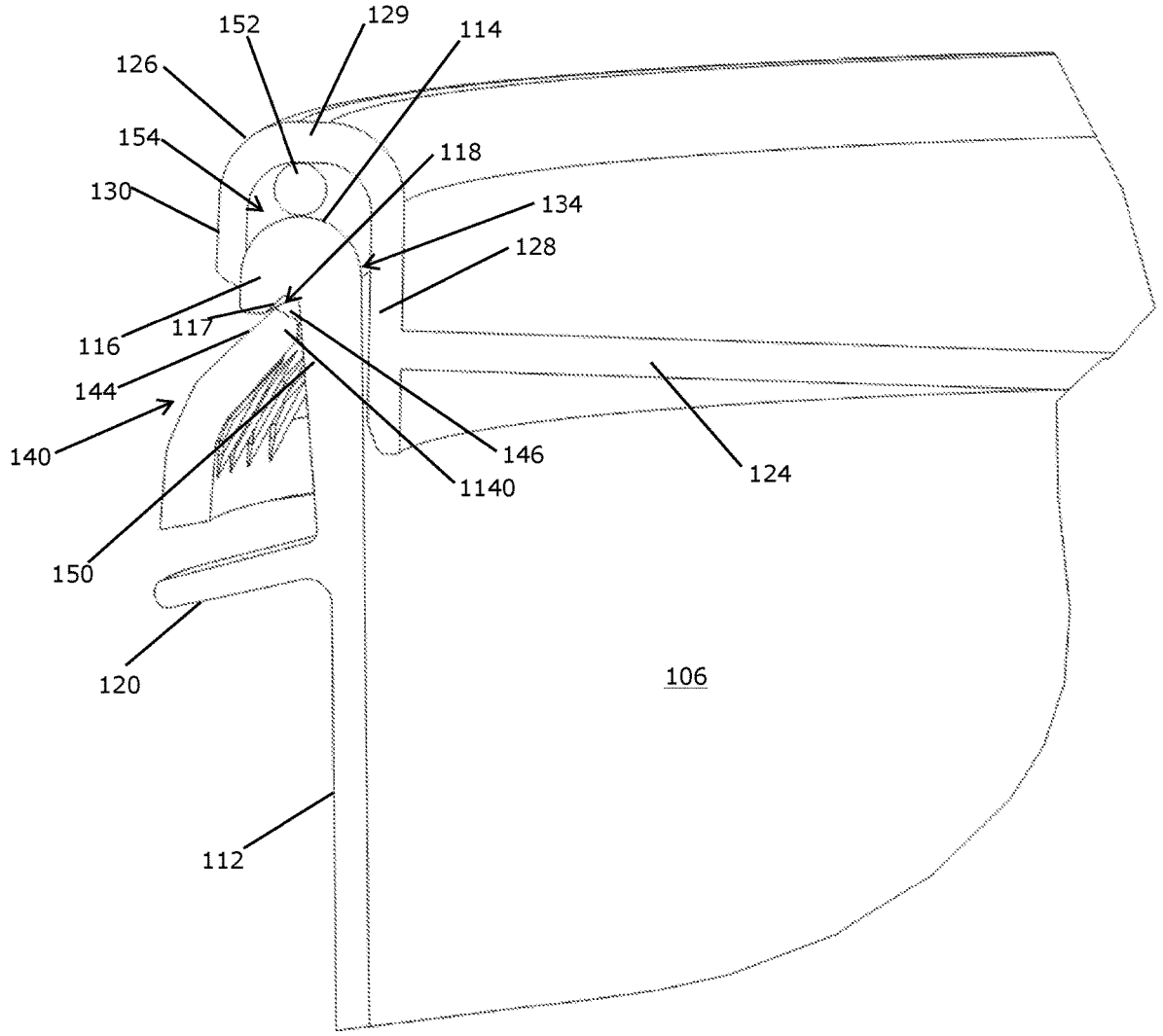
FIG. 12 is a detail, perspective sectional view the container assembly of FIG. 3, as taken along section line B-B in FIG. 3, illustrating the interlock between the lid and the container, with an additional sealing member.
Figure 13:
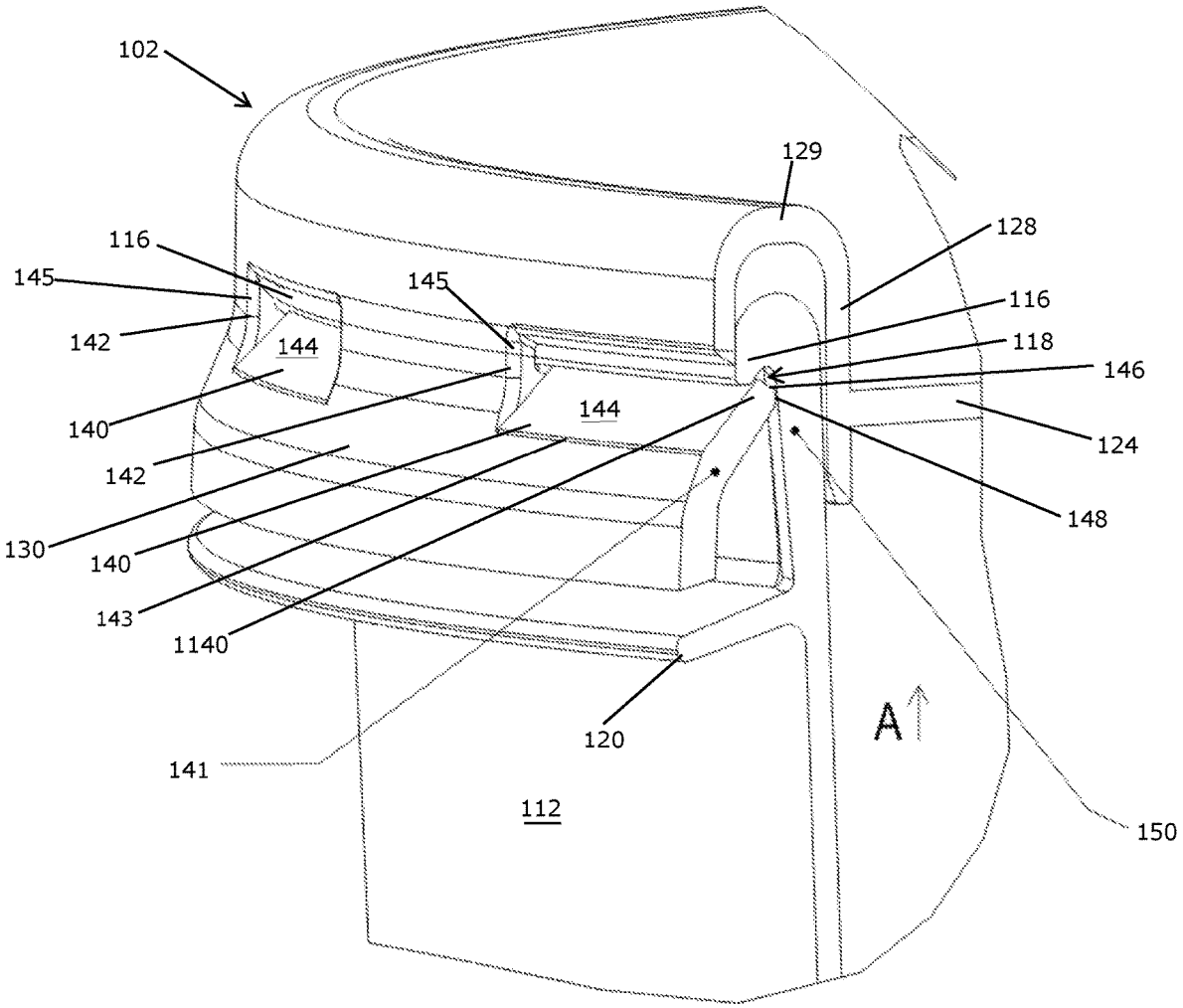
FIG. 13 is a detail, perspective sectional view the container assembly of FIG. 12 illustrating the interlock of the lid and the container from the outside of the container assembly.

As described above, as the lid 102 is disposed on the corresponding container 104, the lid 102 is disposed relative to the container 104 such that the upper rim 114 of the container 104 is received within the container rim-receiving space 134 defined by the peripheral member 126 of the lid 102. As the lid 102 is downwardly displaced relative to the container 104, the upper rim 114 of the container 104 is disposed farther within the container rim-receiving space 134 with effect that the plurality of lid locking members 140 contact the outwardly projecting container lip 116. Continued downward displacement of the lid 102, relative to the container 114, is with effect that the lid locking members 140 flex outwardly relative to the outer skirt 130 of the peripheral member 126, relative to their original disposition relative to the outer skirt 130 of the peripheral member 126. Once the lid 102 has been downwardly displaced relative to the container 104 such that the lid locking members 140 have cleared the outwardly projecting container lip 116, the plurality of lid locking members 140 each, independently, spring-back or snap-back to their original, inwardly disposed configuration, relative to the outer skirt 130, such that at least a portion of each of the lid locking members 140 is, independently, disposed underneath the container lip 116 with effect that the at least a portion of each of the lid locking members 126 that is disposed underneath the container lip 116 is disposed within the lid-locking receiving space 118. As shown in FIG. 12, in some embodiments, disposition of at least a portion of the lid locking member 140 within the lid-locking receiving space 118 is with effect that at least a portion of the outer surface 144 of the lid locking member 140 is disposed underneath or in face-to-face arrangement with the underside 117 of the container lip 116. In some embodiments, for example, protrusion of the lid locking member 140 farther into the lid-locking receiving space 118, in response to upwards forces applied to the lid 102, is such that the outer surface 144 of the lid locking member 140 slides relative to the undersurface 117 of the container lip 116. Accordingly, in some embodiments, for example, the outer surface 144 of the lid locking members 140 is disposed at the same angle, relative to a vertical axis extending through the lid locking member 140 and container lip 116, as at least a portion of the undersurface 117 of the outwardly projecting container lip 116. See for instance FIG. 14. Sliding of the lid locking member 140 relative to the undersurface 117 of the container lip 116 is with effect that the container-engaging end of the lid locking member 140 and the lid-locking member end surface 146 are wedged farther into the lid-locking receiving space 118.

In some embodiments, for example, each of the plurality of lid locking members 140 further define a container wall-abutting surface 148 that extends downwardly away from the lid locking member end surface 146. In some embodiments, for example, as each of the plurality of lid locking members 140, independently, protrude into the lid-locking receiving space 118, the corresponding container wall-abutting surface 148 of each of the plurality of lid locking members 140 is disposed in abutting contact with at least a portion of the outer surface of the container wall element 112.

While the lid 102 is disposed on the container 104 in the locked condition such that such that the container 104 is disposed in a closed condition wherein the plurality of lid locking members 140 are disposed relative to the container 104 such that at least a portion of each of the lid locking members 140 are disposed within the lid-locking receiving space 118 such that at least a portion of the outer surface 144 of each of the lid locking members 140 is disposed underneath or in face-to-face arrangement with the underside 117 of the container lip 116, application of upwards forces applied to the outer skirt 130 of the lid 102 is with effect that the lid locking members 140 are disposed farther into the lid-locking receiving space 118 further wedging the individual lid locking members 140 into the lid-locking receiving space 118. In addition, while the lid 102 is disposed on the container 104 in the locked condition, forces applied against the inner surface of the central panel 124 of the lid 102, for example forces applied to the inner surface of the central panel 124 of the lid 102 by the contents of the closed container assembly 100 in the event that the closed container assembly 100 is dropped (see for instance force "A" illustrated in FIG. 13), is with effect that the lid locking members 140 protrude farther into the lid-locking receiving space 118, providing a more robust interlock between the lid 102 and the container 104. Therefore, in the event that the container assembly 100 is dropped and forces are applied to the central panel 124 of the lid 102 by the contents that occupy the interior space 106 of the container 104, the forces applied to the central panel 124 are unlikely to be sufficient to effect removal of the lid 102 from the container 104 since the forces applied to the central panel 124 are effective for further engaging the lid locking members 140 relative to the container 104 thereby effecting a more robust interlock. Accordingly, while the lid 102 is disposed on container 104 in the locked condition, unintentional removal of the lid 102 from the container 104, is resisted.

Disposition of the plurality of lid locking members 140 at spaced apart intervals about the outer skirt 130 is such that in the event that one of the lid locking members 140 were to become disengaged from within the lid-locking receiving space 118 with the lid locking member 140 slipping out from underneath the container lip 116, the remaining lid locking members 140 are still able to provide a secure engagement between the lid 102 and the container 104. This is unlike conventional lids, such as those illustrated in FIGS. 1-2, wherein disengagement of a portion of the inwardly protruding ridge 28 is sufficient to compromise the engagement between the lid 16 and the container 12 causing the container assembly 10 to be more prone to leakage or more prone to complete failure of the interlock between the lid 16 and the container 12.

Additionally, it will be understood that disposition of the lid 102 on the container 104 is with effect that the inwardly protruding ridge 136 is disposed relative to the container 114 such that the first surface 138 of each of the inwardly protruding ridge portions 136' is disposed underneath the outwardly protruding lip 116 of the container 104. As shown, for example, in FIG. 11, the first surface 138 of each of the inwardly projecting ridge portions 136 extends downwardly away from the undersurface 117 of the container lip 116. However, upwards forces applied to the lid 102 for effecting upwards displacement of the lid 102, relative to the container 104, will bring the first surface 138 of respective ones of the inwardly projecting ridge portions 136' into contact engagement with the undersurface 117 of the container lip 116 for resisting further upwards displacement of the lid 102 relative to the container 104.

Furthermore, as discussed above, upwards forces applied to the lid 102, while the lid 102 is disposed on the container 104 in the locked condition, is effective to further engage the lid locking members 140 within the lid-locking receiving space 118. Therefore, the engagement of the lid locking members 140 within the lid-locking receiving space 118, in combination with contact engagement between the first surface 138 of the inwardly projecting ridge portions 136' and the under surface 117 of the container lip 116, is effective for resisting removal of the lid 102 from the container 104. In some embodiments, for example, removal of the lid 102 from the container 104 once the lid 102 has been disposed on the container 104 in the locked condition can be effected only with use of secondary tool (not shown).

Figure 14:
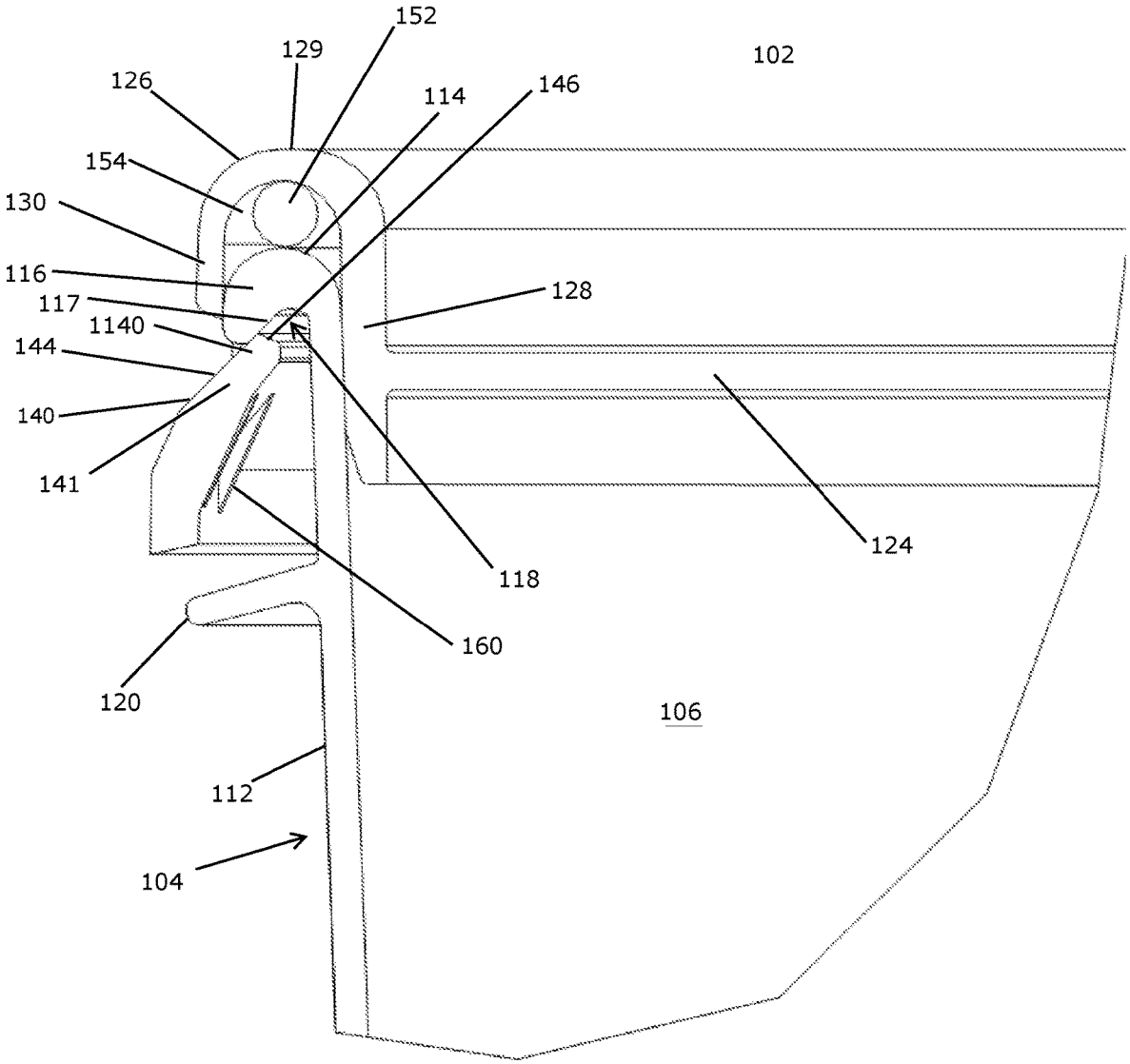
FIG. 14 is a front, cross-sectional view of a container assembly incorporating a lid as illustrated in FIG. 7, illustrating the interlock between the lid of and another example embodiment of a container, the assembly including an additional sealing member.
Figure 15:
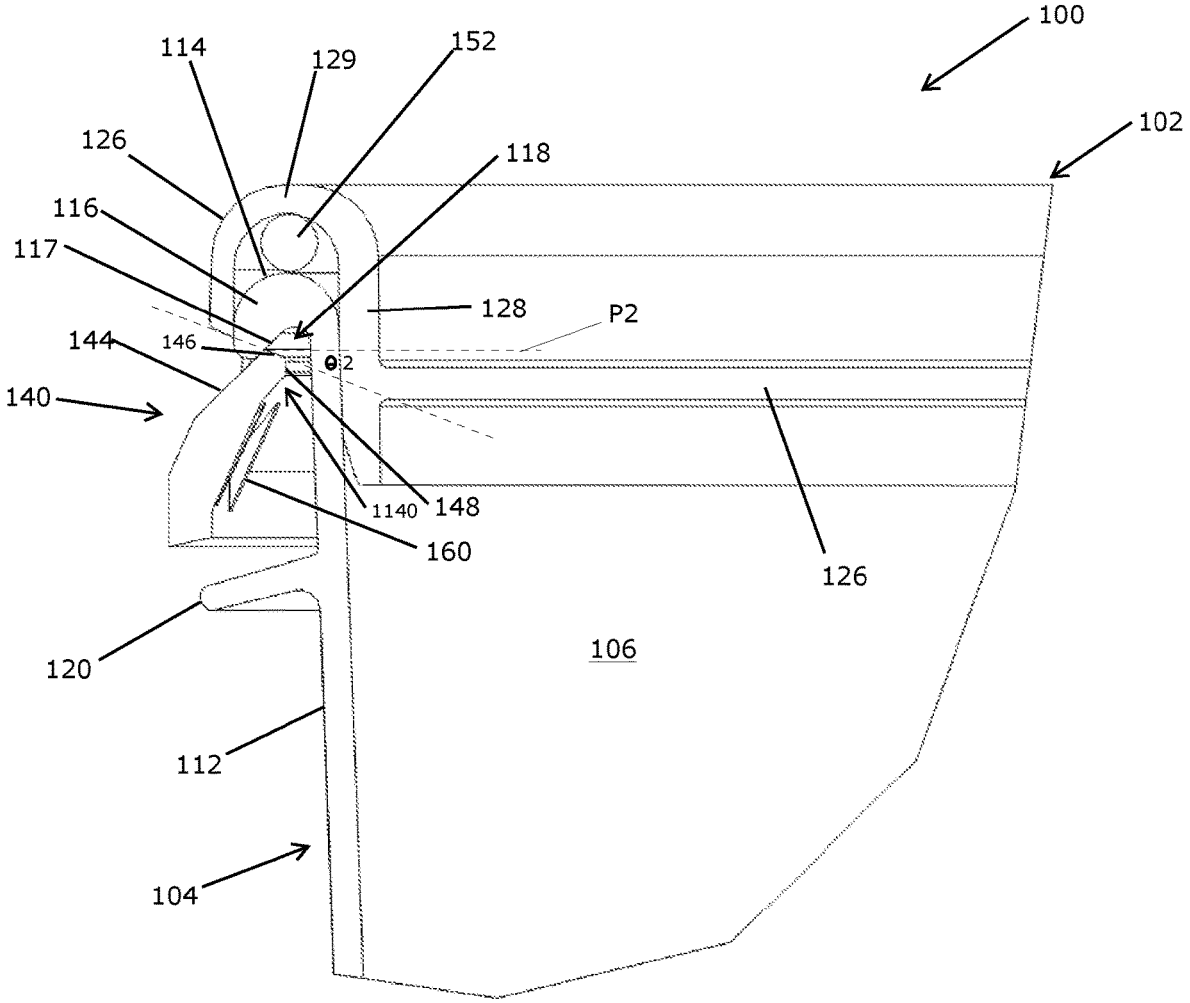
FIG. 15 is a front, cross-sectional view of a container assembly incorporating a lid as illustrated in FIG. 7, illustrating the angled surface of the lid locking member.

Referring now to FIG. 4, in some embodiments, for example, the container 104 for use with the lid 102 includes a plurality of ribs 150 disposed about the outer circumference of container wall element 112. In the subject example embodiment, the plurality of ribs 150 are disposed on the outer surface of the container wall element 112 within the area below the container lip 116 and above outwardly protruding flange 120 that is spaced downwardly away from the container lip 116, at spaced apart intervals about the outer circumference of the container wall element 112. Accordingly, in some embodiments, for example, the plurality of ribs 150 are provided within an area 153 in the form of a circumferential band 152 that extends about the container wall element 112 that is disposed between the under surface of the container lip 116 and the outwardly extending flange 120. Each rib 150 provides an area of increased thickness of the container wall element 112 as is highlighted in the encircled area shown in FIG. 6, which illustrates a cross-sectional view of the container 104 through ribs 150, which provide for an increased wall thickness in the region of the rib 150, as compared to the corresponding area shown in FIG. 5, which shows the standard container wall thickness that is consistent with the wall thickness of the remaining portions of the container 104. In some embodiments, for example, the ribs 150 are configured such that the thickness of the rib 150 increases from the base of the rib 150, proximal outwardly extending flange 120, towards the container lip 116. In some embodiments, for example, the ribs 150 are configured for engaging the lid locking members 140 such that the container wall-abutting surface 148 is disposed in contact engagement with the outer surface of corresponding ones of the plurality of ribs 150, which contact engagement serves to wedge the corresponding lid locking member 140 within the lid-locking receiving space 118. In some embodiments, for example, rather than providing a plurality of ribs 150 disposed about the outer surface of the container 104, the container lip 116 can be configured such that the lid-locking receiving space 118 is appropriately sized and configured for wedging of the lid locking members 140 within the lid-locking receiving space 118. However, it will be understood that the lid 102 may be used with containers 104 have a consistent wall element thickness without ribs 150, as illustrated in FIGS. 14 and 15, for example. In such example embodiments, the lid locking members 140 do not necessarily contact a portion of the outer surface of the container wall element 112 when the lid 102 is disposed on the container 104 in the locked condition. In example embodiments, wherein the container 104 includes the plurality of ribs 150 disposed at spaced apart intervals about the outer circumference of the container 104, it will be understood that the lid locking members 140 will only contact the outer surface of the container 104 in the region of the increased thickness provided by the rib 150, as shown in FIG. 12, and that there will be an absence of contact between the outer surface of the container 104 and the container-engaging end 1140 of the lid locking members 140 in the regions intermediate adjacent ones of the spaced apart ribs 150.

In some embodiments, for example, the lid 102 is configured for use with a corresponding sealing member 152. More specifically, in some embodiments, for example, the peripheral member 126 of the lid 102 is configured for accommodating a sealing member 152 within an uppermost portion 154 of the container rim-receiving space 134 defined between the inner wall 128 and the outer skirt 130. In some embodiments, for example, the sealing member 152 is an O-ring. Accordingly, in such embodiments, the sealing member 152 is disposed within the container rim-receiving space 134 such that it is disposed within the uppermost end 154 of the container rim-receiving space 134 proximal the undersurface of the interconnecting web portion 129 of the peripheral member 126. As the lid 102 is disposed on the container 104, the container rim 114 is disposed within the container rim-receiving space 134 and the lid 102 is downwardly displaced relative to the container 104 such that the upper rim 114 contacts the sealing member 152. Continued downwards displacement of the lid 102, relative to the container 104, is with effect that the sealing member 152 is compressed between the upper rim 114 of the container 114 and the interconnecting web portion 129 of the peripheral member 126 of the lid 102. Compression of the sealing member 152 coincides with the plurality of lid locking members 140 contacting the outer surface of the container lip 116, followed by the inwardly projecting ridge 136 contacting the outer surface of the container lip 116, with both the plurality of lid locking members 140 and the inwardly projecting ridge portions 136' flexing outwardly over the container lip 116 and then snapping back into position underneath the container lip 116 with the lid-locking members 140 securely engaged relative the container lip 116. Once the plurality of lid locking members 140 and the inwardly projecting ridge portions 136' have cleared the container lip 116 such that the lid 102 is disposed in the locked position and the downwards forces applied to the lid 102 are released, the sealing member 152 expands which exerts an upwards force against the interconnecting web portion 129 of the peripheral member 126. The upwards force exerted by the expanding sealing member 152 also serves to cause the lid locking members 140 to be wedged farther into the lid locking-receiving space 118 thereby further reinforcing the robust interlock between the lid 102 and the container 104.

As discussed above, the lid 102 according to the above described example embodiments is configured to facilitate the manufacturing process, in particular when the lid 102 is formed via injection molding techniques, due to the configuration of the lid locking members 140 and the configuration of the inwardly projecting ridge 136. Additionally, the manufacturing process of the lid 102 is further improved by the provision of the plurality of lid locking members 140 that are disposed at spaced apart intervals about the outer skirt 130 of the peripheral member 126 given that the amount of material required to form the plurality of lid locking members 140 is significantly reduced as compared to a lid configuration incorporating a continuous lid locking ridge having the profile of the individual lid locking members 140, thereby resulting in a more cost effective lid 102 that offers a weight reduction over conventional lids while still providing a container assembly with a robust interlock.

Referring now to FIGS. 17-21 there is shown another example embodiment of a container assembly 100 according to the present disclosure. The container assembly 100 includes lid 102, as previously described, and a container (or pail) 104' that is configured for cooperating with the lid 102. In the subject example embodiment, the container 104' has a closed bottom or base end 108, and open top end 110 and an upwardly extending tubular wall element 112 that extends from the closed bottom or base end 108 to the open top end 110, the upwardly extending tubular wall element 112 terminating at upper rim 114. The upper rim 114 of the upwardly extending tubular wall element 112 defines the perimeter of the open, top end 110 of the container (or pail) 104. As in the previously described embodiment, the upper rim 114 of tubular wall element 112 of the container 104 includes an outwardly extending container lip 116 that extends about the perimeter of the open top end 110 of the container 104. The outwardly extending lip 116 extends both outwardly and downwardly away from the open, top end 110 of the container 104 with effect that a lid-locking receiving space 118 is defined by the concave undersurface 117 of the container lip 116. In some embodiments, for example, the outwardly extending lip 116 has a curled configuration, the lip 116 curling away from the upper rim 114 of the upwardly extending tubular wall element 112 such that the outwardly extending lip 116 has a concave undersurface 117 that defines the lid-locking receiving space 118.

In the subject example embodiment, the container 104' includes a circumferentially extending rib 1150 that protrudes from the outer surface of the upwardly extending tubular wall element 112. The circumferentially extending rib 1150 protrudes from the outer surface of the upwardly extending tubular wall element 112 such that at least a portion of the circumferentially extending rib 115 is disposed at a distance below of the end edge of the outwardly extending lip 116, as measured along the longitudinal axis of the container 104. Accordingly, in some embodiments, for example, the circumferentially extending rib 1150 is spaced apart from the end edge of the outwardly extending lip 116 such that the lid-locking receiving space 118 is defined with a recess that is bounded by the undersurface 117 of the outwardly extending lip 116 and an upper surface 1152 of the circumferentially extending rib 1150. In some embodiments, for example, the circumferentially extending rib 1150 extends continuously about the outer surface of the container wall element 112. In some embodiments, for example, the circumferentially extending rib 1150 is a circular rib that extends bout the outer surface of the container wall element 112.

Figure 19:
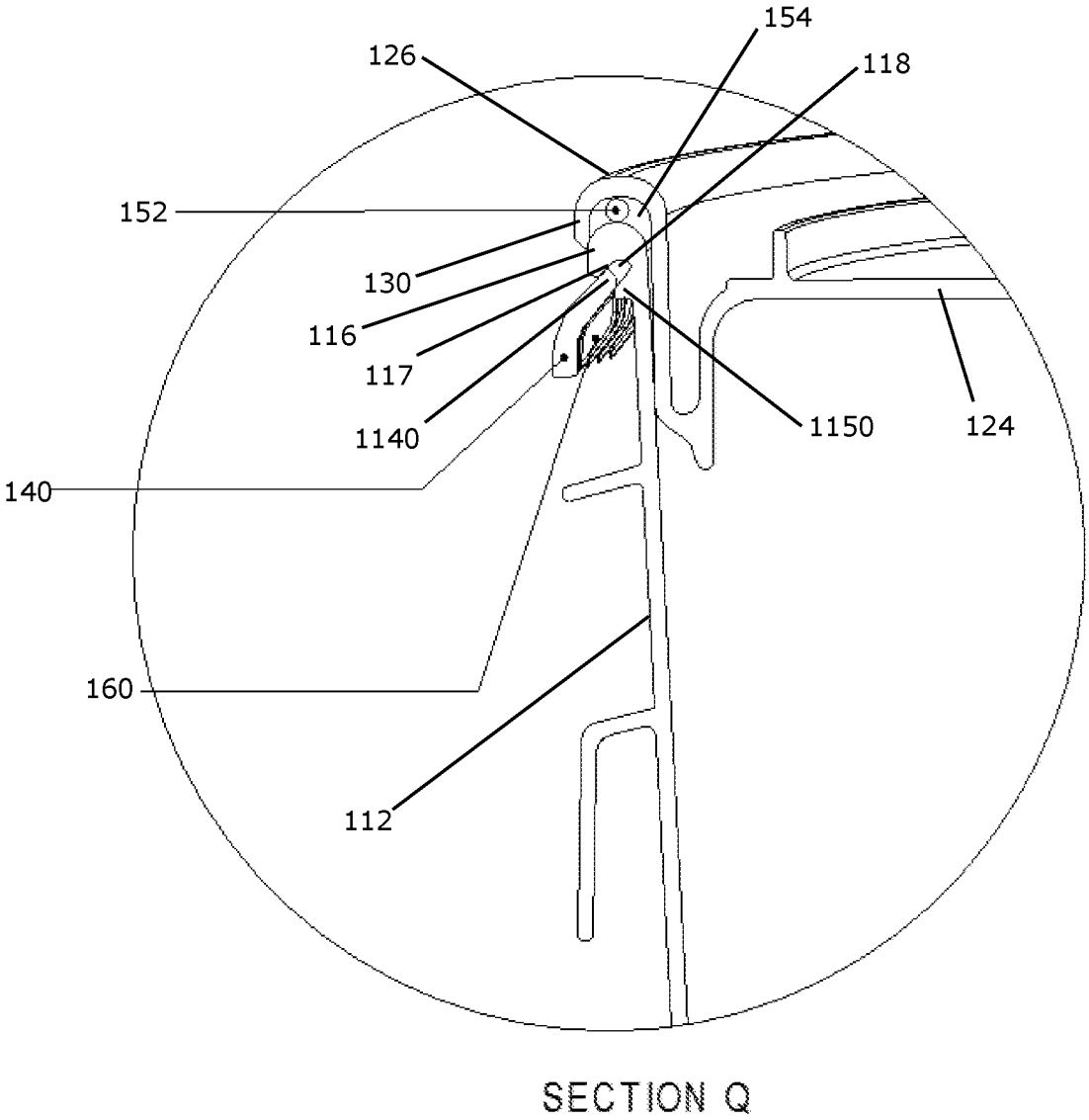
FIG. 19 is detail, sectional view of the container assembly of FIG. 17, as taken along section line Q-Q, illustrating the interlock between the lid and the container.
Figure 20:
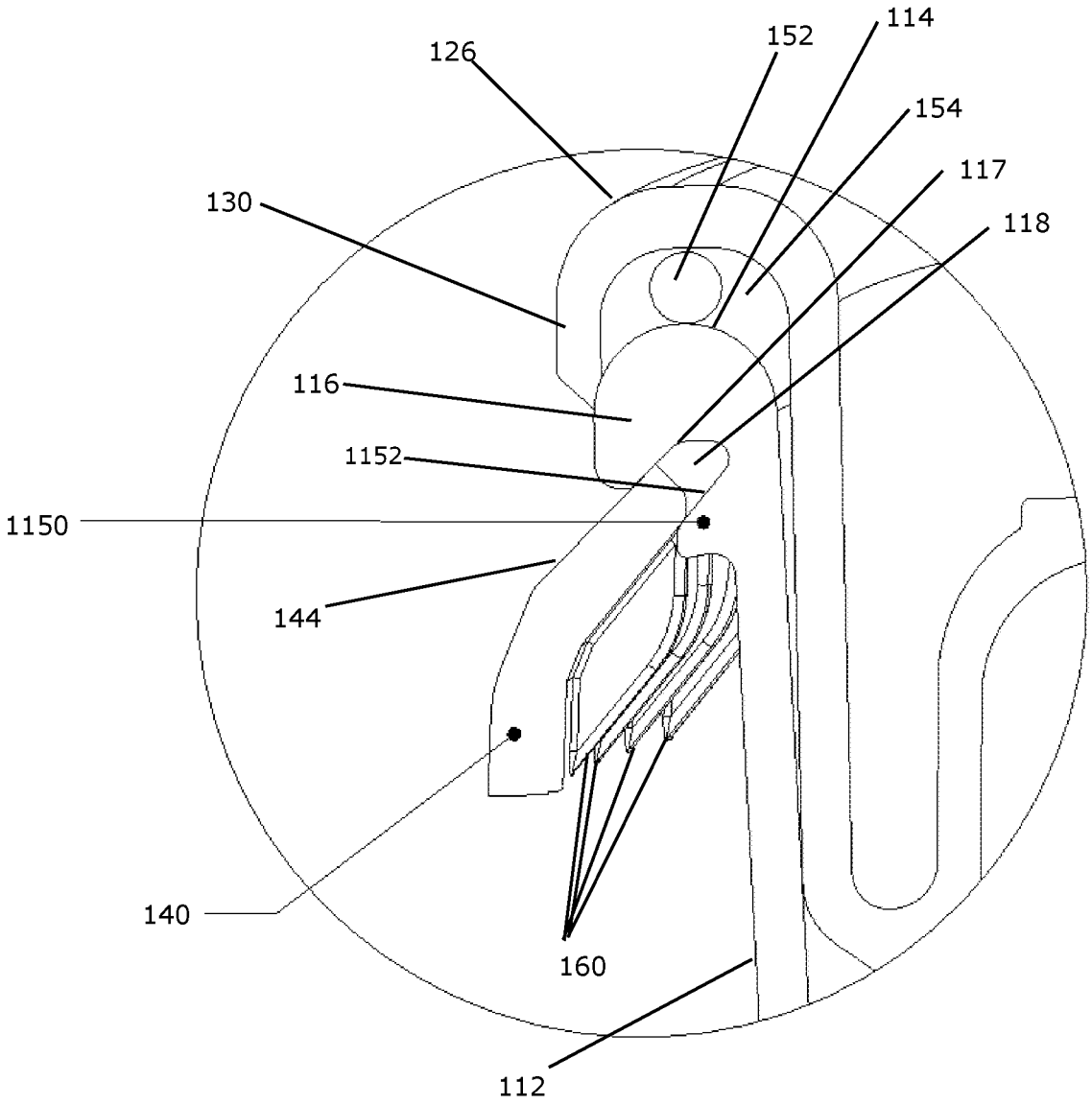
FIG. 20 is a detail view of FIG. 19 further illustrating the interlock between the lid and the container.
Figure 21:
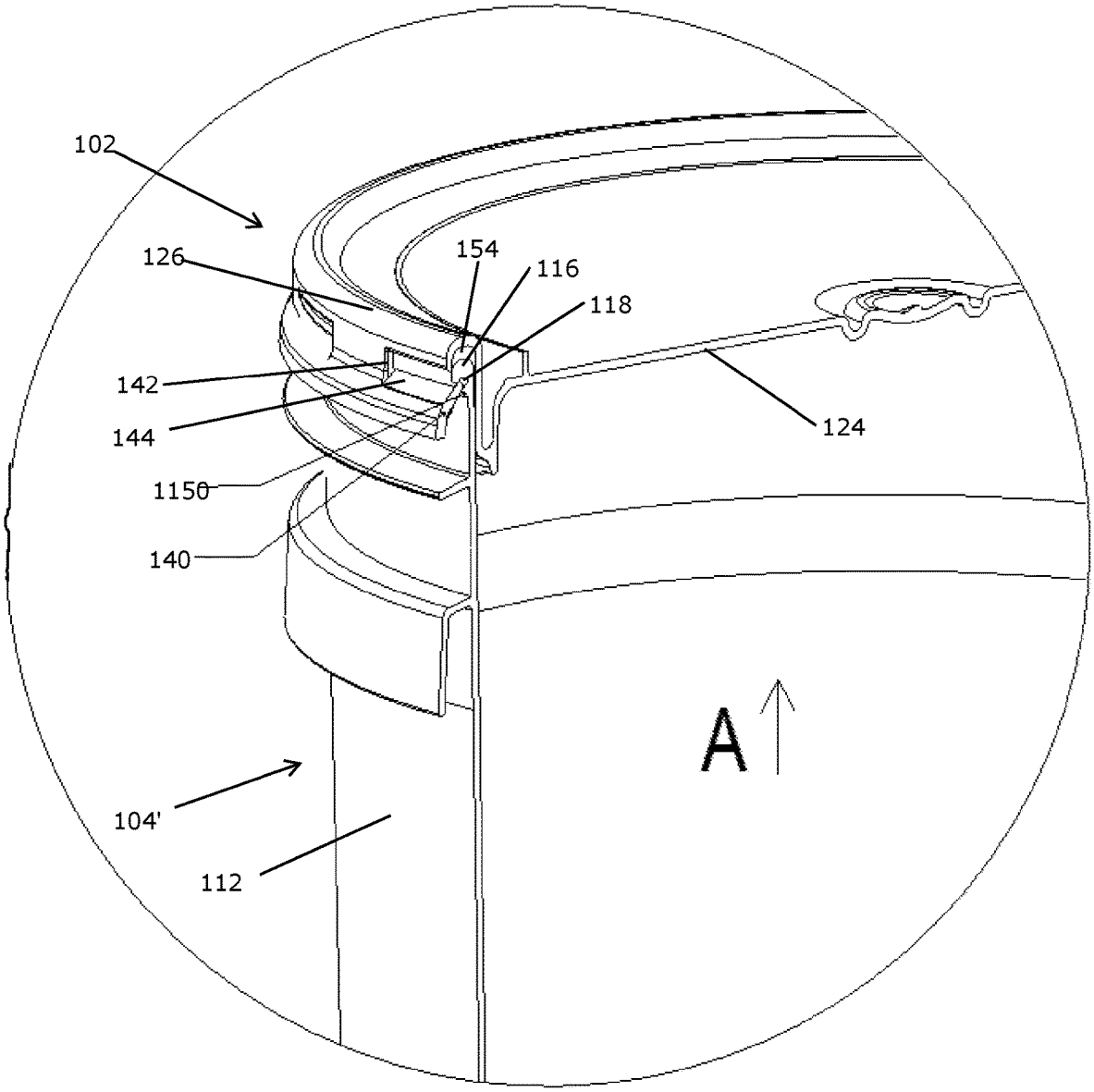
FIG. 21 is a detail, perspective sectional view the container assembly of FIG. 17, as taken along section line Q-Q, as viewed from the outside of the container assembly
Figure 22:
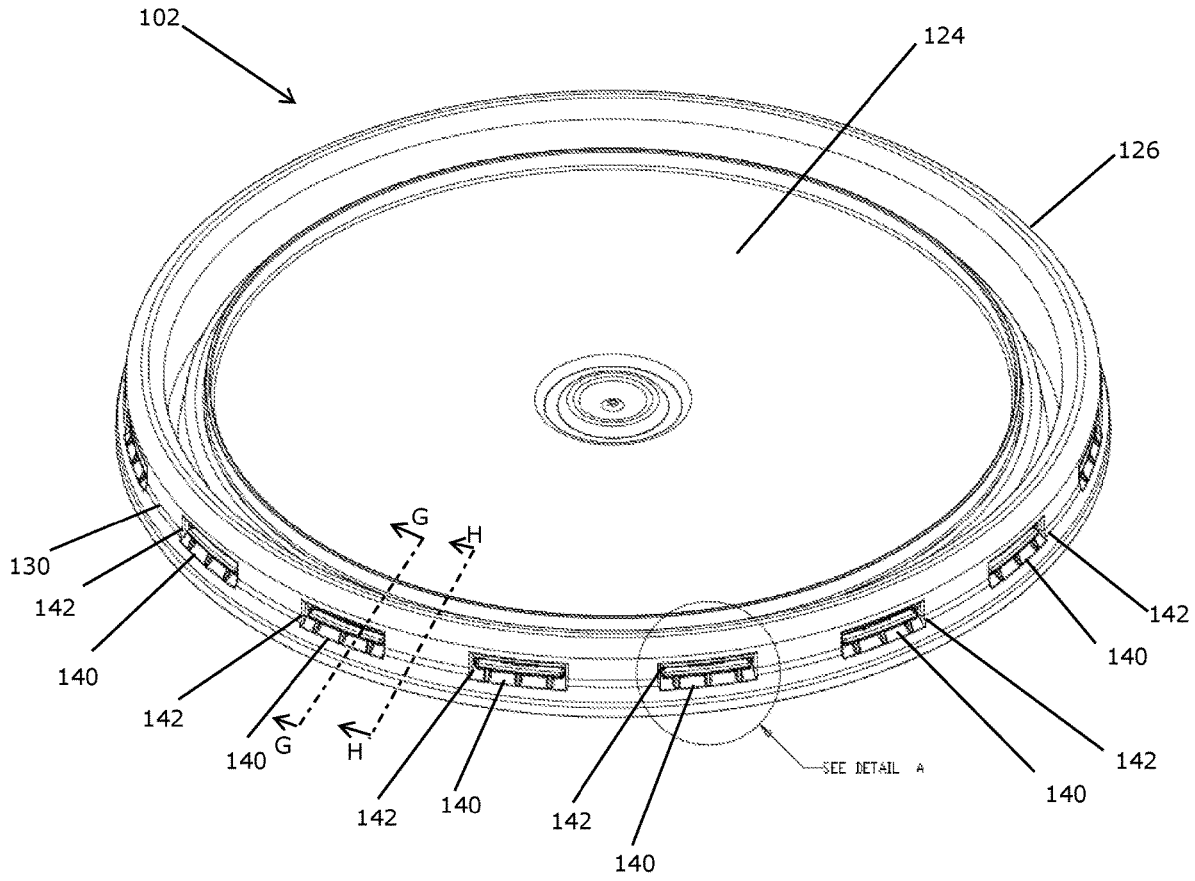
FIG. 22 is top perspective view of a lid according to another example embodiment of the present disclosure.
Figure 23:
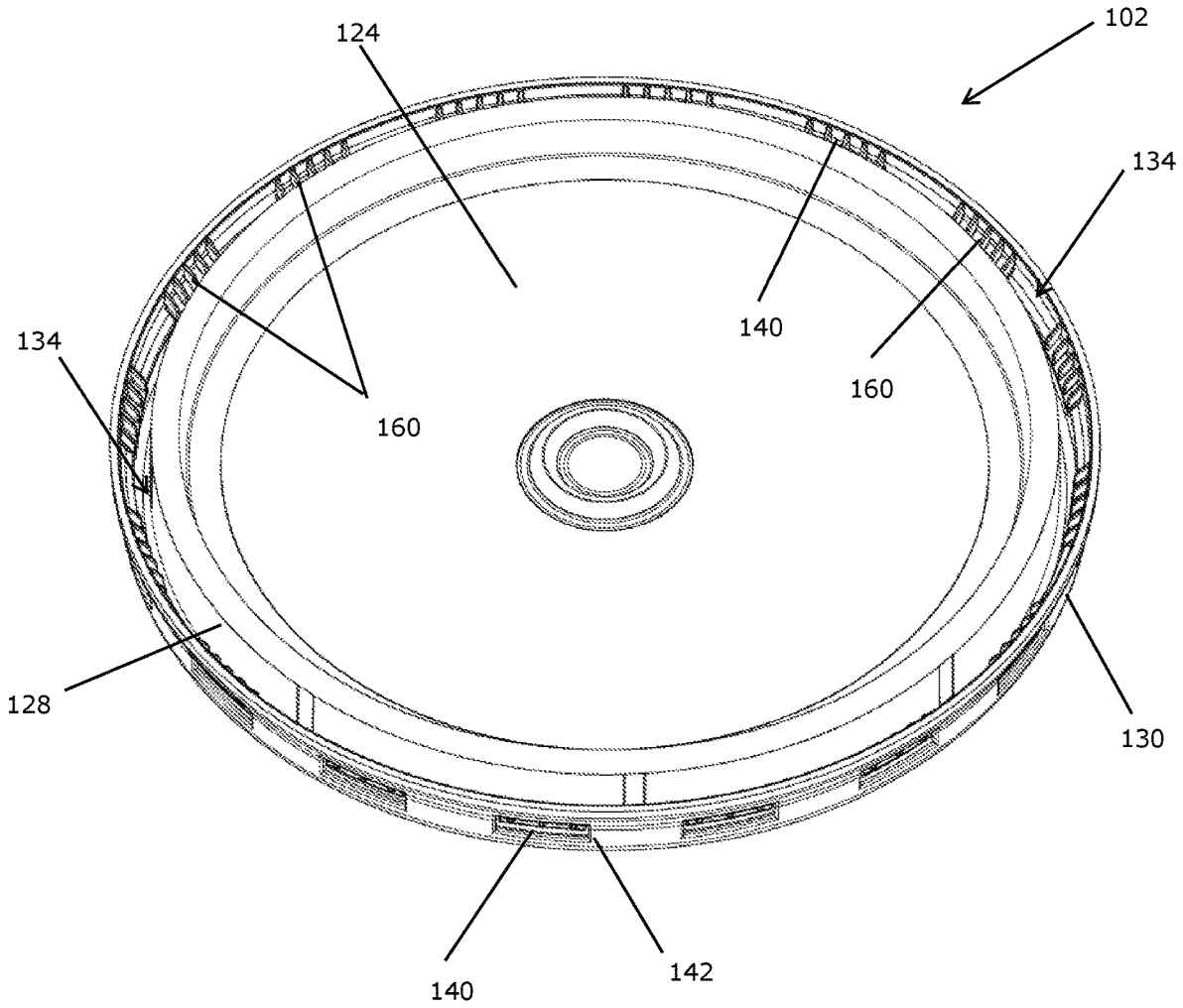
FIG. 23 is a bottom, perspective view of the underside of the lid FIG. 22.
Figure 24:
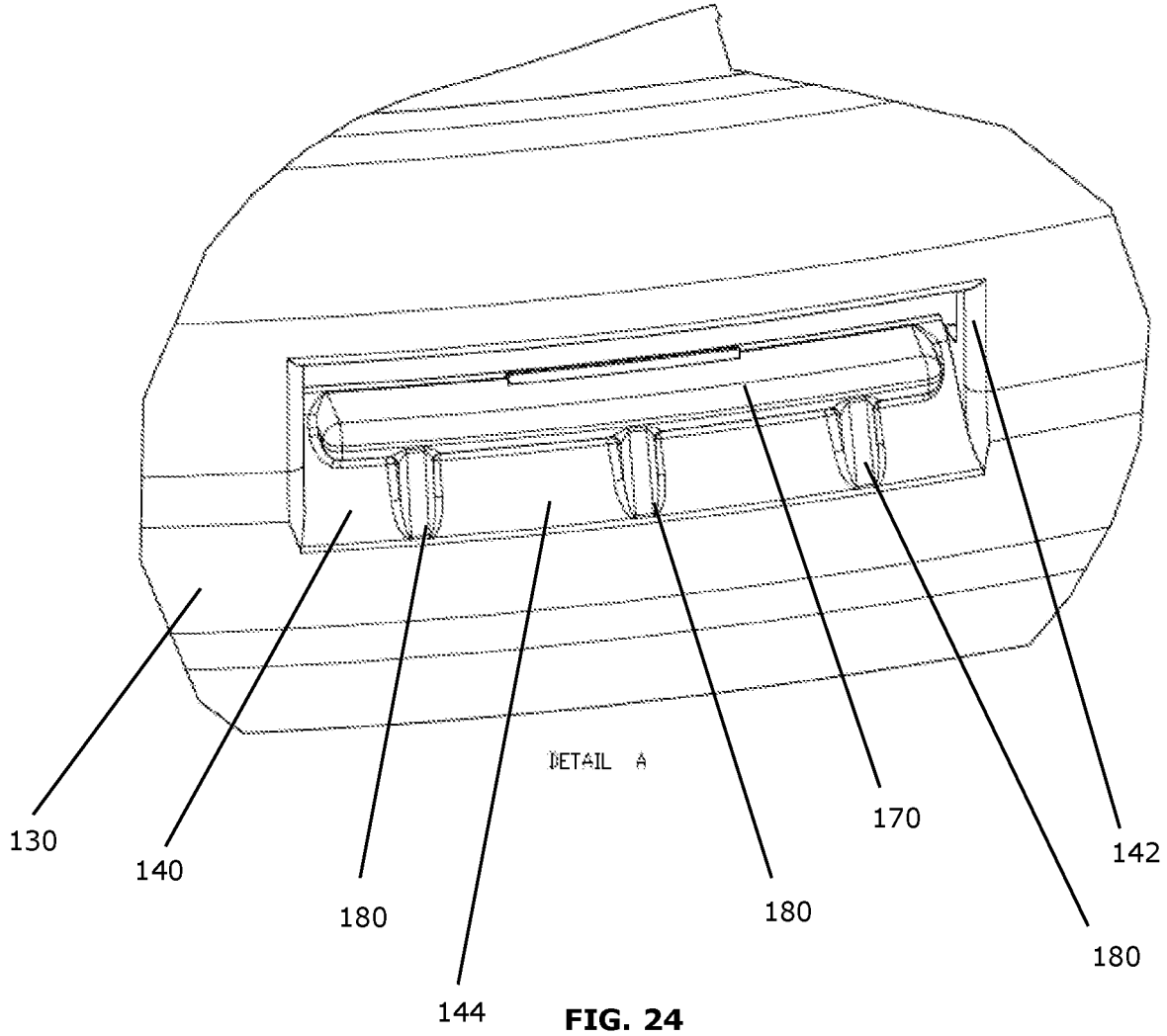
FIG. 24 is a detail view of the encircled area "A" of FIG. 22.
Figure 25:
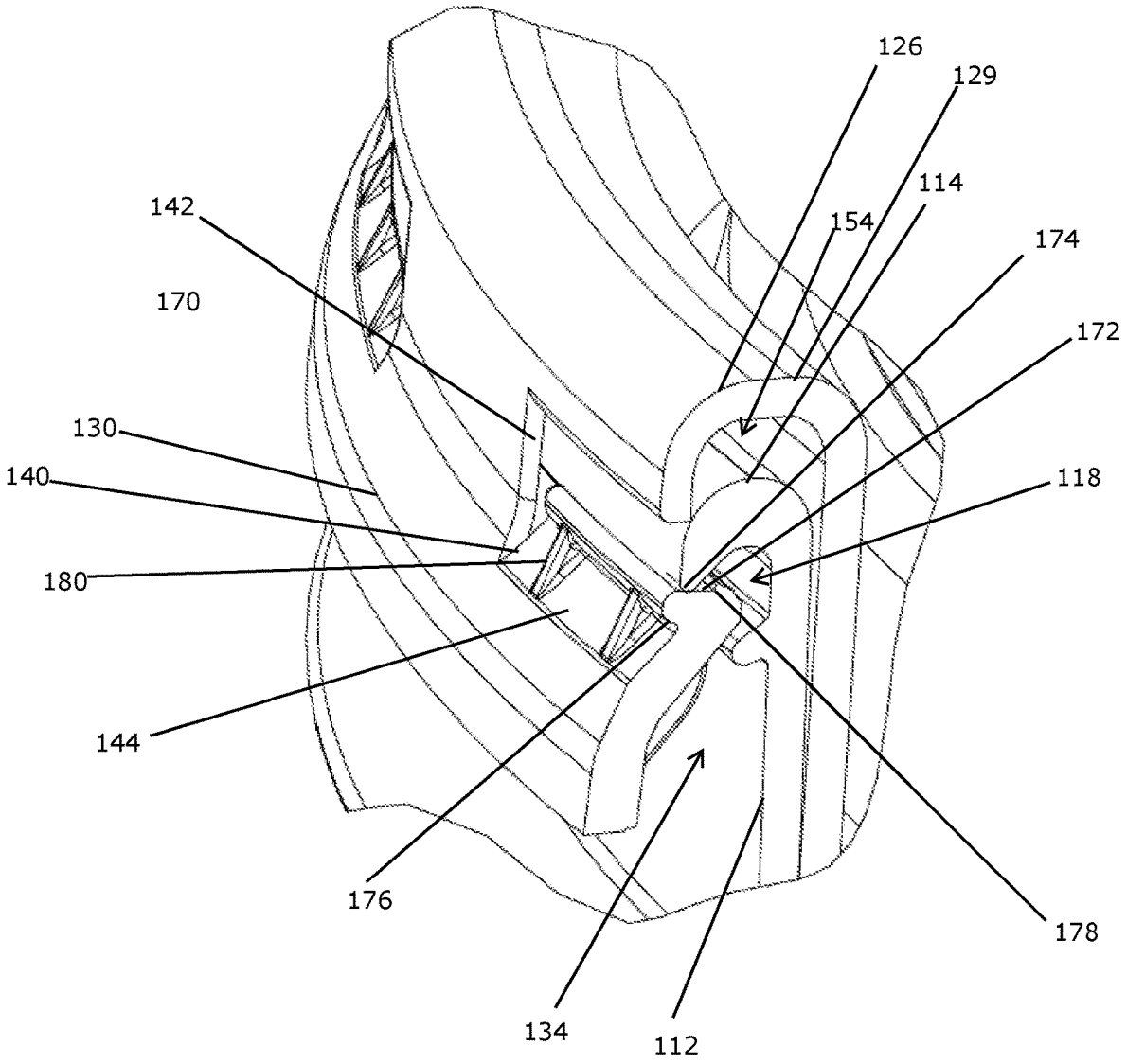
FIG. 25 is a detail, perspective sectional view taken through section line G-G illustrated in FIG. 22, while the lid is disposed on a container illustrating the interlock of the lid and the container.
Figure 26:
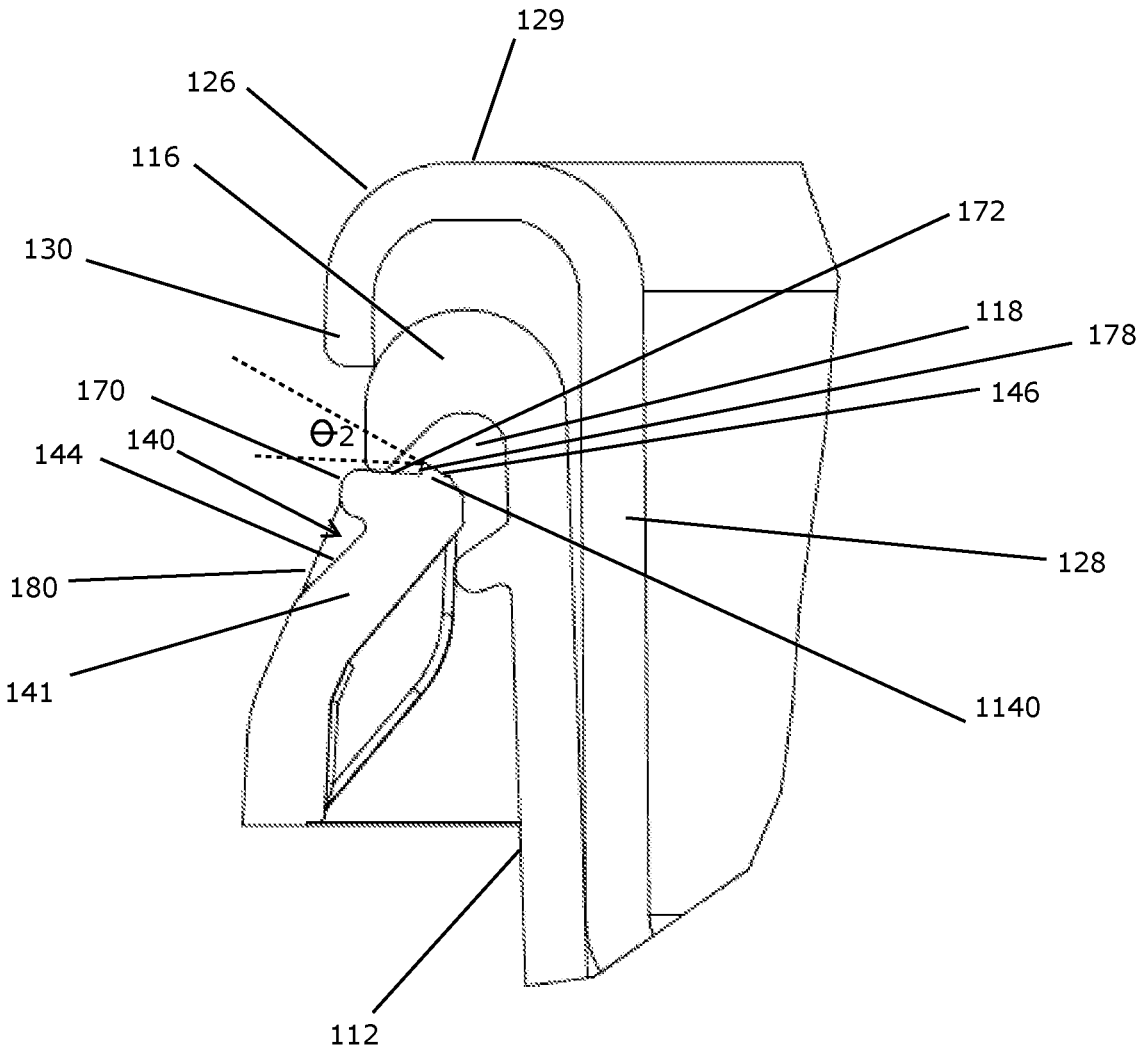
FIG. 26 is an end view of the perspective, sectional view of FIG. 25.
Figure 27:
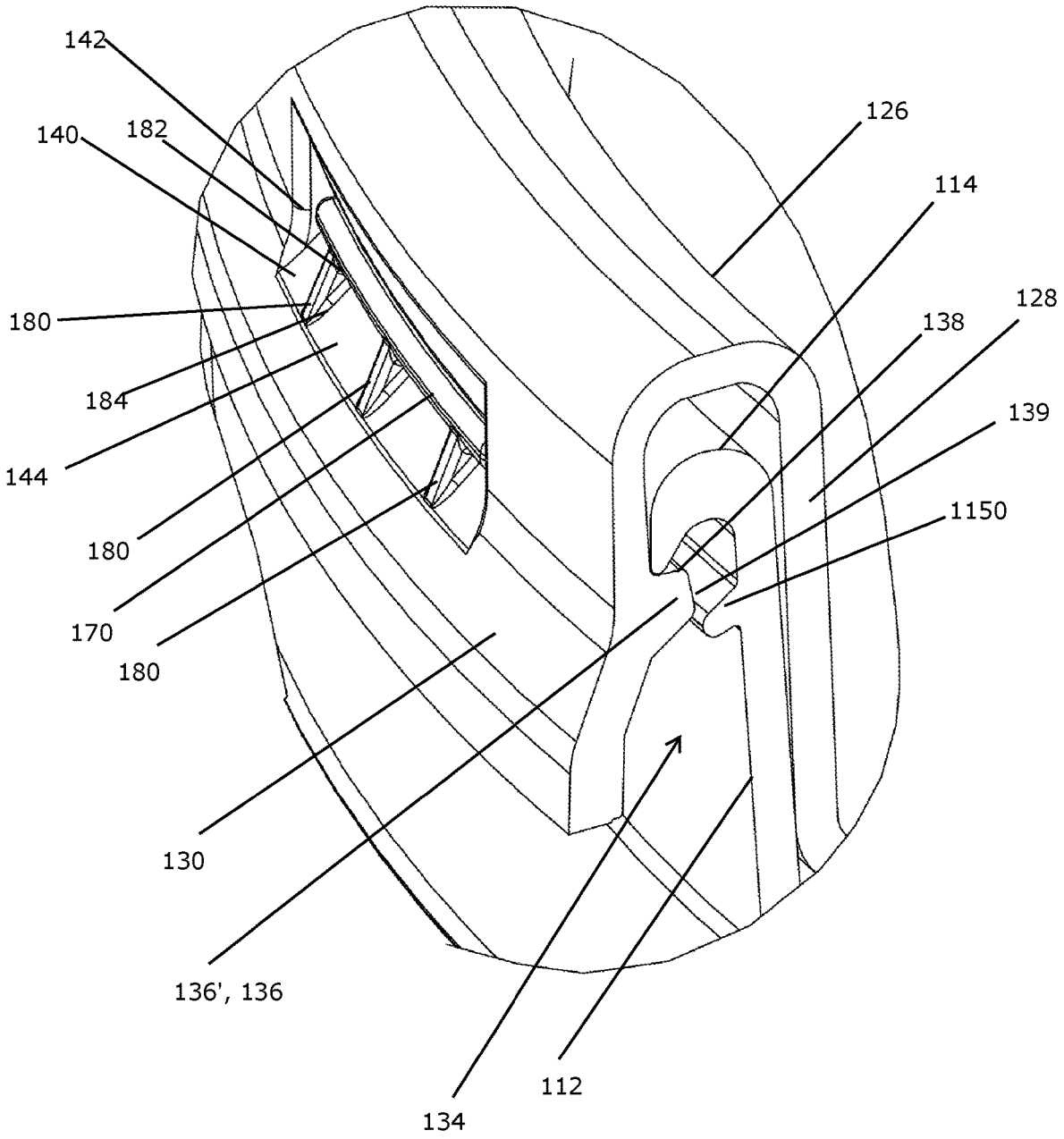
FIG. 27 is a detail, perspective sectional view through section line H-H illustrated in FIG. 22 while the lid is disposed on a container illustrating the interlock of the lid and the container in the regions intermediate the lid locking members.
Figure 28:
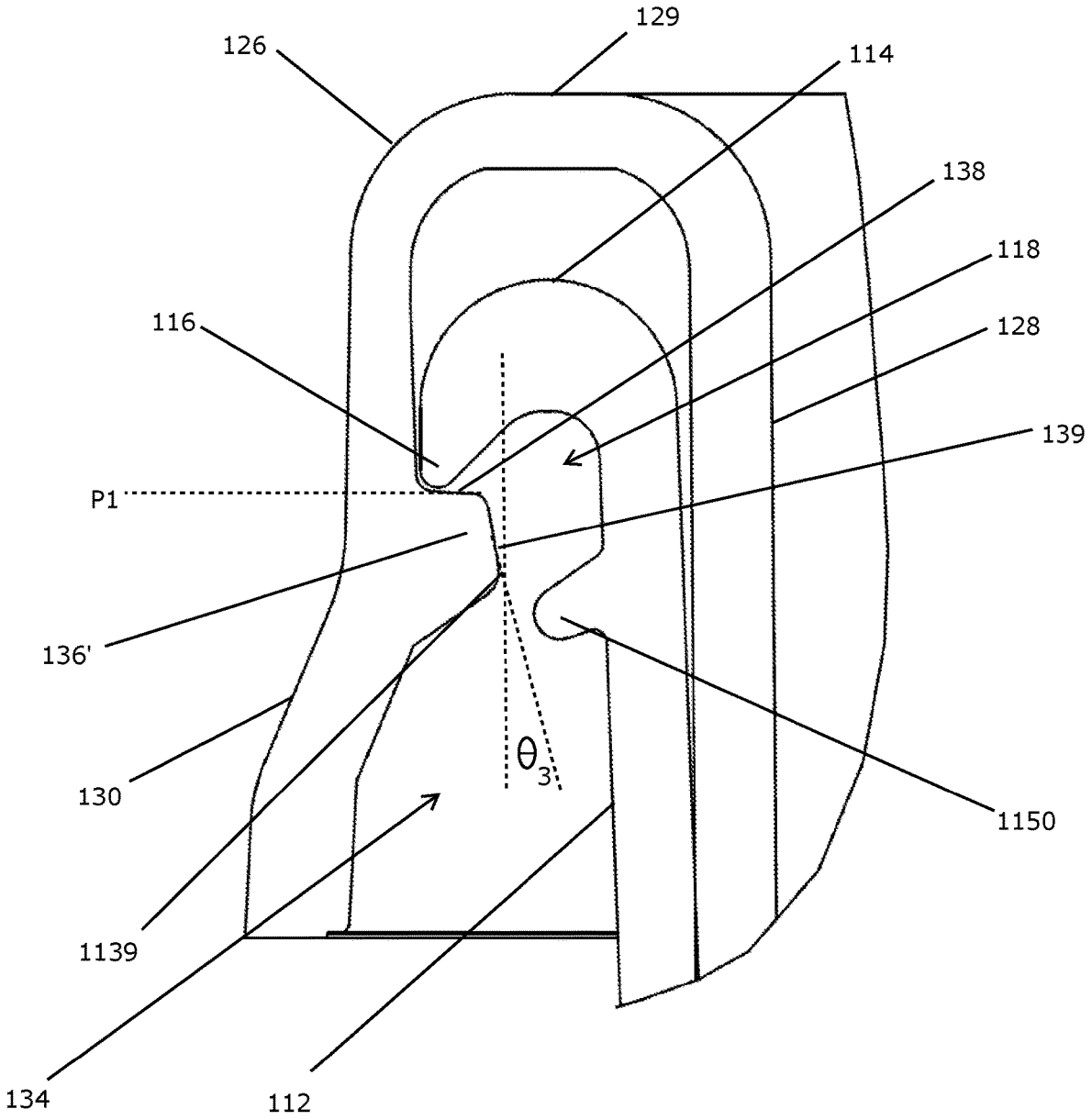
FIG. 28 is an end view of the perspective sectional view of FIG. 27.

With reference now to FIGS. 19-21, when a lid 102, as described in connection with the embodiments of FIGS. 7-11, is disposed on the container 104', the lid-locking members 140 deflect outwardly over the container lip 116, as the lid 102 is downwardly displaced relative to the container 104'. Once the lid-locking members 140 clear the outwardly extending lip 116, the lid-locking members 140 spring or snap back to their neutral position such that the lid-locking members 140 become engaged within the associated with the lid 102 become engaged within the lid-locking receiving space 118 between the undersurface 117 of the outwardly extending lip 116 and the circumferentially extending rib 1150. Accordingly, disposition of the container-engaging end 1140 of the lid-locking members 140 within the lid-locking receiving space 118 as the lid 102 is disposed on the container 104' is supported or further enhanced by the circumferentially extending rib 1150 of the container 104' as disengagement of one or more of the plurality lid-locking members 140 from the lid-locking receiving space 118, in response to forces applied to the lid 102, is resisted by engagement and/or interference between the lid locking members 140 and the upper surface 1152 of the circumferentially extending rib 1150.

With reference, in particular to FIGS. 20-21, in some embodiments, for example, the circumferentially extending rib 1150 is configured such that the upper surface 1152 of the circumferentially extending rib 1150 slopes downwardly away from the outer surface of the upwardly extending tubular wall element 112 such that the circumferentially extending rib 1150 has a wedge-shaped profile. In some embodiments, for example, the downwardly-sloping upper surface 1152 of the circumferentially extending rib 1150 is disposed at the same angle, relative to an axis that extends parallel to the longitudinal axis of the container 104', as the inner or interior surface of the lid-locking members 140. In other embodiments, for example, the downwardly-sloping upper surface 1152 of the circumferentially extending rib 1150 is disposed at an angle, relative to an axis that extends parallel to the longitudinal axis of the container 104', that is different than the angle of the inner or interior surface of the lid-locking members 140, relative to an axis that extends parallel to the longitudinal axis of the container 104'. In some embodiments, for example, engagement of the lid-locking members 140 within the lid-locking receiving space 118 is with effect that the inner or interior surface of the container-engaging end 1140 of each of lid-locking members 140, independently, rests against or engages the downwardly sloping upper surface 1152 of the circumferentially extending rib 1150 such that the circumferentially extending rib 1150 supports the engagement of the lid locking members 140 within the lid-locking receiving space 118. Accordingly, in some embodiments, for example, the circumferentially extending rib 1150 serves to increase the locking strength of the engagement between the lid 102 and the container 104', once the lid 102 is disposed on the container 104' in the locked condition such that the container 104' is disposed in the closed state, thereby providing for a more robust interlock between the lid 102 and the container 104'. Specifically, unauthorized removal of the lid 102 from the container 104' is resisted as upwards forces applied to the outer edge of the lid 102', relative to the container 104' is with effect that the lid locking members 140 will impinge against the circumferentially extending rib 1150 such that disengagement of the lid-locking members 140 from the lid-locking receiving space 118 is resisted. Additionally, upwards forces applied to the lid 102 by the contents of the container 104' in response to drop tests is with effect that the lid-locking members 140 become further engaged within the lid-locking receiving space 118 as the lid-locking members 140 slide along the sloped upper surface 1152 of the circumferentially-extending rib 1150.

In some embodiments, for example, the provision of a circumferentially extending rib 1150 on the outer surface of the upwardly extending tubular wall element 112 has been found to require less resin to manufacture as compared to the plurality of ribs 150 that are disposed about the outer circumference of the container wall element 112 as shown, for example, in FIG. 4. Accordingly, in some embodiments, for example, the container 104' of FIGS. 17-21 may not only provide for a more robust interlock between the lid 102 and the container 104' but may also provide manufacturing advantages over conventional container assemblies.

Referring now to FIGS. 22-28 there is shown another example embodiment of a lid 102 for a container assembly 100 according to another example embodiment the present disclosure. In the subject example embodiment, the lid locking members 140 and the inwardly projecting ridge 136, or inwardly projecting ridge portions 136', are cooperatively configured to provide a robust interlock between the lid 102 and the corresponding container (or pail) 104. In such example embodiment, each one of the lid locking members 140, independently, includes a lid-locking member support 170 that projects rearwardly away from the outer surface 144 of the lid locking member 140. In some embodiments, for example, the a lid-locking member support 170 extends along the outer surface 144 of the lid-locking member 140 from one side edge 141 of the lid locking member 140 to the other side edge 141 of the lid locking member 140.

In some embodiments, for example, the lid-locking member support 170 is spaced downwardly away from the lid-locking member end surface 146 such that when the lid 102 is disposed on the container 104, the container-engaging end 1140 and the end surface 146 of the lid-locking member 140 are disposed within the lid locking-receiving space 118 defined by the upper rim 116 of the container 104 (or pail), while the lid-locking member support 170 extends away from the outer surface 144 of the lid locking member 140 and underneath the container lip 116. In some embodiments, for example, while the lid 102 is disposed on the container 104 such that the container 104 is disposed in a closed condition, an end edge 174 of the container lip 116 is disposed on top of and/or in contact with an upper support surface 172 defined by the lid-locking member support 170 with the lid-locking member support 170 extending beyond the outer surface of the container lip 116. In some embodiments, for example, while the lid 102 is disposed on the container 104 such that the container 104 is disposed in a closed condition, the upper support surface 172 defined by the lid-locking member support 170 is disposed underneath and spaced apart from the end edge 174 defined by the container lip 116 such that the upper support surface 172 contacts the end edge 174 defined by the container lip 116 in response to upwards forced being applied to the outer skirt 130 of the lid 102, relative to the container 104. The rearward extension of the lid-locking member support 170 relative to the outer surface 144 of the lid-locking member 140, and relative to the outer surface of the container lip 116 creates an overhang 176 of the lid-locking member support 170 relative to the outer surface 144 of the lid-locking member 140. As the lid-locking member support 170 is spaced downwardly away from the end surface 146 of the container-engaging end 1140 of the lid-locking member 140 (e.g. forming an undercut) on the outer surface 144 of the lid locking member 140, a stop surface 178 is defined by an outer surface portion of the container-engaging end 1140 of the lid-locking member 140, the stop surface 178 extending from the end surface 146 of the container-engaging end 1140 of the lid locking member 140 to the upper support surface 172 defined by the lid-locking member support 170. In some embodiments, for example, the stop surface 178 extends perpendicular to the upper support surface 172 defined by the lid locking member support 170 along the length of the lid locking member 140. Accordingly, the lid-locking member support 170 is positioned relative to the end surface 146 of the container engaging end 146 of the lid-locking member 140 such that when the lid 102 is positioned on the container 104 such that the container 104 is disposed in the closed condition, the container engaging end 1140 of each one of the plurality of lid locking members 140, independently, extends into the lid-locking receiving space 118 defined by the container lip 116 while the lid-locking member support 170 is disposed underneath the end edge 174 of the container lip 116.

In some embodiments, for example, the container-engaging end 1140 of each one of the plurality of lid locking members 140, independently, extends inwardly into the lid-locking receiving space 118 such that the container-engaging end 1140 is more inwardly disposed, relative to the central longitudinal axis of the container 104 or container assembly 100, than the opposite portion of the lid locking member 140 that is connected to the outer skirt 130. In some embodiments, for example, the container engaging end 1140 and the lid-locking member support 170 of each one of the plurality of lid locking members 140, independently, are cooperatively configured such that the container engaging end 1140 extends into the lid-locking receiving space 118 defined by the upper rim 114 and lip 116 of the container 104 by at least 0.005 inches as measured from the inner surface defined by the container lip 116 towards outer surface of the container wall element 112 along an axis that extends parallel to the upper support surface 172 defined by the lid-locking member support 170. In some embodiments, for example, the container engaging end 1140 extends into the lid-locking receiving space 118 defined by the upper rim 114 and lip 116 of the container 104 by at least inches. In some embodiments, for example, the container-engaging end 1140 extends into the lid-locking receiving space 118 defined by the upper rim 114 and lip 116 of the container 104 by at least 0.030 inches. Accordingly, it will be understood that the specific distance by which the container-engaging end 1140 of the lid locking member 140 extends into the lid-locking receiving space 118 may vary depending on the overall size and configuration of the container 104 and lid 102 as well as the particular application of the overall container assembly 100 formed by the container 104 and the lid 102.

In reference to the example embodiment of FIGS. 22-28, in such a configuration, when upwards forces are applied to the peripheral member 126 of the lid 102 (for example in an effort to remove the lid 102 from the container 104) and/or when upwards forces are applied to the central panel 124, from within the container 104 such as, for example, hydraulic forces applied to the central panel 124 of the lid 102 by the liquid contents stored within the container 104 acting against the central panel 124 (e.g. in response to dropping and/or mishandling of the closed container assembly 100), one or more of the lid-locking members 140, independently, are driven further inwardly and upwardly into the lid-locking receiving space 118 until the lid-locking member support 170, of the respective one or more of the plurality of lid-locking members 140, impinges against a corresponding portion of the end edge 174 defined by the container lip 116. The impingement of the lid-locking member support 170 against the corresponding portion of the container lip 116 is with effect that further upwards displacement of the container-engaging end 1140 into the lid-locking receiving space 118 is resisted. As well, any further inwards displacement of the container-engaging end 1140 into the lid-locking receiving space is guided along the upper support surface 172 of the lid-locking member support 170, thereby preventing the end surface 146 of the container-engaging end 1140 of the lid-locking member 140 from unintentionally impinging against the uppermost portion of the under surface defines by the container lip 116 with the effect that the interconnecting web portion 129 of the peripheral member 126 lifts away from the upper rim 114 of the container 104 thereby defeating the sealing interface effected with the sealing member 152 (not shown) within the upper most portion 154 of the container-rim receiving space 134. Accordingly, in some embodiments, for example, the resisting of the further upwards projection of the container-engaging end 1140 of the lid-locking member 140 into the lid-locking space 118, in some instances, has been found to be effective for maintaining a sealed interface between the underside of the container lid 102 and the upper rim 114 of the container 104 in response to the application of upwards forces applied to the lid 102 while the lid 102 on the container 104. In particular, in some instances, it has been found that further inwards and upwards projection of the one or more lid-locking members 140 into the lid-locking receiving space 118, beyond a predetermined effective amount of inwards projection for maintaining a secure interlock between the lid 102 and the container 104, effects upwards displacement of the lid 102 relative to the container 104. In some instances, the upwards displacement of the lid 102 relative to the container 104 is such that the compression of the sealing member 152 (not shown in FIGS. 24-28 for ease of illustration) that is disposed within the uppermost portion 154 of the container rim-receiving space 134 and that is compressed between the interconnecting web portion 129 and the upper rim 114 of the container 104 when the lid 102 is pushed downwardly on to the container 104, such that the lid 102 is engaged with the container 104 for effecting a sealing interface between the underside of the lid 102 and the upper rim 114 of the container 104, is defeated and/or otherwise compromised.

In some embodiments, for example, each one of the lid-locking members 140, independently, further includes a plurality of supporting ribs 180 that are disposed at spaced apart intervals along the outer surface 144 of the lid locking member 140 and are arranged underneath the lid-locking member support 170. Each one of the supporting ribs 180, independently, is configured to resist downwards deflection of the lid-locking member support 170 in response to upwards forces being applied to the lid 102 while the lid 102 is engaged on the container 104 in the closed condition. In this respect, each one of the supporting ribs 180 projects outwardly from the outer surface 144 of the lid locking member 140 and has a first portion 182 connected or otherwise coupled to the undersurface of the overhanging portion 176 of the lid locking member support 170, and a second portion 184 that is connected or otherwise coupled to the outer surface 144 of the lid locking member 140. In some embodiments, the supporting ribs 180 are integrally formed with the lid 102 such that the first portion 182 merges with the under surface of the lid locking member support 170 while the second portion 184 merges with the outer surface 144 of the lid locking member 140. In some embodiments, for example, each one of the supporting ribs 180, independently, is wedge-shaped. The supporting ribs 180 are configured to resist deflection of the lid locking member support 170 in an effort to prevent downwards deflection of the lid locking member support 170 that would permit the lid-locking member 140 to project further inwardly and/or upwardly into the lid-locking space 118 with effect that the sealing interface that is effected between the underside of the lid 102 and the upper rim 114 of the container 104 by the compression of the sealing member 152 is defeated.

With reference again to the example embodiment illustrated in FIGS. 22-28, in some embodiments, for example, each one of the inwardly projecting ridge portions 136', independently, defines a second surface 139 that extends downwardly from an end edge of the first surface 138 such that the second surface 138 is disposed generally opposite to the outer surface of a corresponding portion of the container wall element 112 when the lid 102 is disposed on and engaged with the container 104. In some embodiments, for example, the second surface 139 extends from the end edge of the first surface 138 at an angle, θ3, relative to an axis that extends parallel to the central longitudinal axis of the container assembly 100, when the lid 102 is disposed on the container 104, such that a bottom edge 1139 of the inwardly projecting ridge portion 136' extends farther inwardly into the container-rim receiving space 134 than the end edge of the first surface 138 from which the second surface 139 extends. In some embodiments, for example, the second surface 139 extends generally perpendicular to the first surface 138 of the respective inwardly projecting ridge portion 136' In some embodiments, for example, the inwardly projecting ridge portions 136' are integrally formed with the lid 102 and project inwardly into the container rim receiving space 134 such that the first surface 138 extends into the container rim-receiving space 134 from the inner surface of the outer skirt 130 by a distance of at least 0.05 inches, as measured along an axis that extends parallel to the first surface 138 of the inwardly projecting ridge portion 136'.

By providing inwardly projecting ridge portions 136' having a first surface 138 that extends parallel to a horizontal plane that extends through the outer skirt with a second surface 138 that extends downwardly and further inwardly into the container-rim receiving space 134 along with lid locking members 140 that each, independently, include a lid locking member support 170 with support ribs 180 on the outer surface 144 of the respective lid locking member 140 with the container-engaging end 1140 of each one of the lid-locking members extending into the lid-locking receiving space 118, it has been found that a robust interlock between the lid 102 and the container 104 is achieved. In particular it has been found that the cooperation between the engagement between the peripheral member 126 of the lid 102 and the upper rim 114 of the container 104 that is provided by the individual lid locking members 140 together with the resistance to deflection provided by the inwardly projecting ridge portions 136' that extend between adjacent ones of the lid-locking members 140 is effective for resisting upwards displacement of the lid 102, relative to the container 104, in response to upwards forces applied to the peripheral member 126 and/or upwards forces applied to the central panel 124 of the lid 102, from within the container 104), that would otherwise compromise the closed condition of the container assembly 100 and/or defeat the sealing interface that is effected between the underside of the lid 102 and the upper rim 114 of the container 104 by compression of the sealing member 152.

Figure 29:
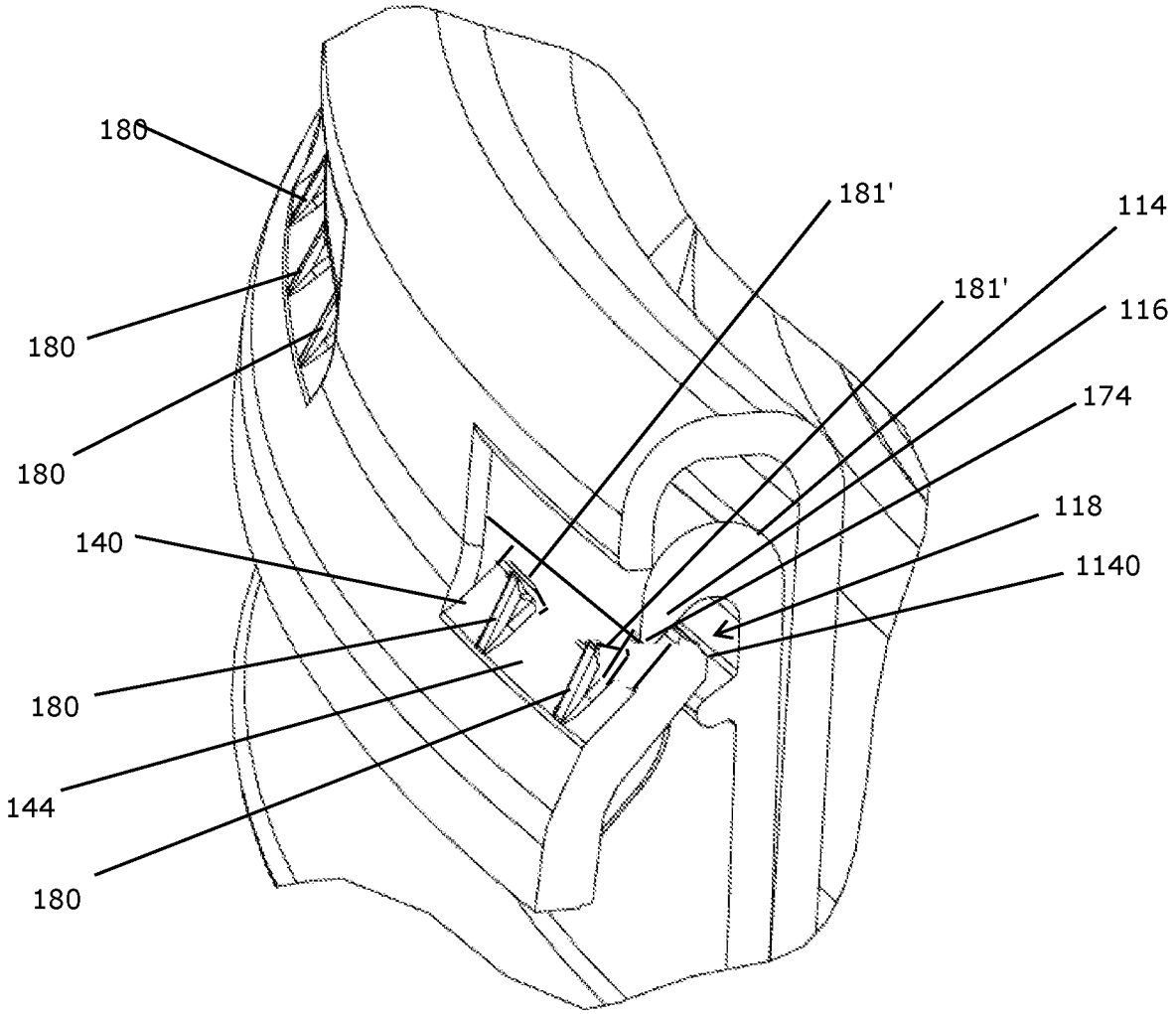
FIG. 29 is a is a detail, perspective sectional view of another example embodiment of a lid according to the present disclosure taken through a section line similar to section line G-G as illustrated in FIG. 22, while the lid is disposed on a container illustrating the interlock of the lid and the container.

With reference to FIG. 29 there is shown another example embodiment of the present disclosure. In such example embodiment, rather than providing a lid-locking member support 170 extending along the outer surface 144 of each one of the plurality of lid locking members 140 from one side edge surface 141 to the other side edge 142 surface, each one of the lid locking members 140, independently, is provided with a plurality of support ribs 180 disposed at spaced apart intervals along the outer surface 144 of the lid locking member 140. In this respect, each one of the plurality of support ribs 180 are configured to provide a stop surface 181' that will impinge against the end edge 174 of the container lip 116 in response to upwards forces being applied to the lid 102, while the lid 102 is disposed on the container 104, that effects upwards displacement of at least some portions of the outer skirt 130 relative to the upper rim 114 of the container 104. Accordingly, in such example embodiments, the resistance to further upwards displacement of the container-engaging end 1140 of each one of the plurality of lid-locking members 140 into the lid locking receiving space 118 is provided at discrete spaced apart intervals along the outer surface 144 of the lid locking members 140 rather than along the continuous upper support surface 172 provided by the lid-locking member support 170. In some instances, providing the plurality of support ribs 180 with respective stop surfaces 181' rather than the lid-locking member support 170 has been found to provide sufficient support to the lid locking members 140 and to form a robust interlock between the lid 102 and the corresponding container 104 in a container assembly 100 that is particular suited for lighter duty applications as compared to heavy duty applications.

While various embodiments of the lid 102 and container assembly 100 have been described, it will be understood that certain adaptations and modifications of the described embodiments can be made. Therefore, the above discussed embodiments are considered to be illustrative and not restrictive.

What is claimed is:

1. A lid for a container, the container having a closed bottom end and a container wall element defining an open, interior container space, the container wall element having an upper rim defining an open end of the container and including an outwardly projecting container lip defining a lid-locking receiving space, the lid comprising:

a central panel;

a peripheral member extending from a periphery of the central panel, the peripheral member having:

an inner wall member extending from the periphery of the central member;

an outer skirt defining an outer perimeter of the lid, wherein the outer skirt is disposed in spaced apart relationship from the inner wall member such that a container rim-receiving space is defined between the inner wall member and the outer skirt that is configured for receiving the upper rim of the container;

a plurality of lid locking members defined within the outer skirt and disposed at spaced apart intervals about the outer skirt, each one of the plurality of lid locking members, independently, extending from the outer skirt to a distal end that is free from connection to the outer skirt;

and an inwardly projecting ridge extending from an inner surface of the outer skirt and extending about the inner circumference of the outer skirt such that an inwardly projecting ridge portion is disposed between adjacent ones of the plurality of lid locking members;

wherein:

the plurality of lid locking members are each, independently, configured to flex, relative to the outer skirt;

and while the lid is disposed on the container such that the lid is disposed in a locked condition closing the container:

the upper rim of the container is disposed within the container rim-receiving space;

the inwardly projecting ridge is disposed below the container lip and the plurality of lid locking members are disposed relative to the container lip such that at least a portion of the distal end of each one of the plurality of lid locking members is disposed within the lid-locking receiving space defined by the container lip;

and each one of the plurality of lid locking members, independently, further comprises:

a plurality of lid locking member support ribs disposed at spaced apart intervals along an inner surface of a respective one of the plurality of lid locking members for supporting the respective lid locking member relative to the outer skirt such that downwards deflection of the respective one of the lid locking member relative to the outer skirt is resisted by the plurality of lid locking member support ribs.

2. The lid as claimed in claim 1;

wherein:

while the lid is disposed on the container such that the lid is disposed in a locked condition, such that the container is disposed in a closed condition:

the plurality of lid locking members are disposed relative to the container lip such that the distal end of each of the plurality of lid locking members is disposed in a first position within the lid-locking receiving space; and application of an upwards force applied to the lid, relative to the container, is with effect that:

the distal end of at least one of the plurality of lid locking members is disposed in a second position within the lid-locking receiving space;

wherein:

the second position is more inwardly disposed relative to an under surface defined by the container lip than the first position.

3. The lid as claimed in claim 1;

wherein:

the plurality of lid locking members each, independently, includes:

an outer surface; and a lid locking member end surface extending downwardly away from an upper edge of the lid locking member.

4. The lid as claimed in claim 3;

wherein:

the lid locking member end surface extends downwardly away from the upper edge of the outer surface at a downwards angle, θ2, of between a minimum of 0° to a maximum of 70°, relative to a horizontal plane that intersects the upper edge of the outer surface.

5. The lid as claimed in claim 1;

wherein:

the inwardly projecting ridge includes a first surface that extends downwardly away from an interior surface of the outer skirt at an angle, θ1, relative to a horizontal plane that intersects the outer skirt, wherein the angle θ1, is greater than 0° and less than or equal to 70°.

6. The lid as claimed in claim 1;

wherein:

the inwardly projecting ridge defines a first surface that extends parallel to a horizontal plane that intersects the outer skirt.

7. The lid as claimed in claim 5;

wherein:

the lid locking member end surface extends downwardly away from the upper edge of the outer surface at a downwards angle, θ2, of between a minimum of 0° to a maximum of 70°, relative to a horizontal plane that intersects the upper edge of the outer surface;

and the angle, θ1, at which the first surface extends downwardly away from the interior surface of the outer skirt, and the angle, θ2, at which the lid locking member end surface extends downwardly away from the upper edge of the outer surface of the lid locking member, are the same.

8. The lid as claimed in claim 5;

wherein:

the lid locking member end surface extends downwardly away from the upper edge of the outer surface at a downwards angle, θ2, of between a minimum of 0° to a maximum of 70°, relative to a horizontal plane that intersects the upper edge of the outer surface;

and the angle, θ1, at which the first surface extends downwardly away from the interior surface of the outer skirt, and the angle, θ2, at which the lid locking member end surface extends downwardly away from the upper edge of the outer surface of the lid locking member, are different.

9. The lid as claimed in claim 1;

wherein:

while the lid is disposed on the container in the locked condition such that the container is disposed in the closed condition:

disengagement of one of the plurality of lid locking members relative to the container lip such that the distal end of the one of the plurality of lid locking members is disposed outwardly relative to the container lip is with effect that, removal of the lid, relative to the container, in response to upwards forces applied to the lid is resisted via interference between remaining ones of the plurality of lid locking members and the container lip.

10. The lid as claimed in claim 1;

wherein:

the plurality of lid locking members are spaced apart equidistantly around the perimeter of the outer skirt.

11. The lid as claimed in claim 1;

wherein:

each one of the plurality of lid locking members, independently, extends inwardly, relative to the outer skirt, such that a corresponding opening is defined in the outer skirt for each one of the plurality of lid locking members.

12. The lid as claimed in claim 11;

wherein:

the plurality of lid locking members each, independently, have oppositely disposed side edges, each lid locking member, independently, extending between the oppositely disposed side edges; and the plurality of lid locking members are configured such that the side edges of each one of the plurality of lid locking members, independently, are free from connection to the corresponding opening, and free from connection to the inwardly projecting ridge.

13. The lid as claimed in claim 11;

wherein:

the plurality of lid locking members each, independently, have oppositely disposed side edges, each lid locking member, independently, extending between the oppositely disposed side edges; and the plurality of lid locking members are configured such that the side edges of each one of the plurality of lid locking members, independently, are integrally connected to at least a portion of a corresponding side edge defined by the corresponding opening, and are integrally connected with the inwardly projecting ridge.

14. The lid as claimed in claim 3;

wherein:

each one of the plurality of lid locking members, independently, defines a container wall-abutting surface that extends downwardly away from the lid locking member end surface; and while the lid is disposed on the container in the locked condition such that the container is disposed in a closed condition, the distal end of each one of the plurality lid locking members, independently is disposed within the lid-locking receiving space such that:

the container wall-abutting surface is disposed in abutting contact with a portion of an outer surface of the container such that downwards displacement of the distal end of at least one of the plurality of lid locking members, relative to the outer skirt within the lid-locking receiving space is resisted, due to interference between the container wall-abutting surface defined by the at least one of the plurality of lid locking members and the portion of an outer surface of the container.

15. A lid for a container, the container having a closed bottom end and a container wall element defining an open, interior container space, the container wall element having an upper rim defining an open end of the container and including an outwardly projecting container lip defining a lid-locking receiving space, the lid comprising:

a central panel;

a peripheral member extending from a periphery of the central panel, the peripheral member having:

an inner wall member extending from the periphery of the central member;

an outer skirt defining an outer perimeter of the lid, wherein the outer skirt is disposed in spaced apart relationship from the inner wall member such that a container rim-receiving space is defined between the inner wall member and the outer skirt that is configured for receiving the upper rim of the container;

a plurality of lid locking members defined within the outer skirt and disposed at spaced apart intervals about the outer skirt, each one of the plurality of lid locking members, independently, extending from the outer skirt to a distal end that is free from connection to the outer skirt;

and an inwardly projecting ridge extending from an inner surface of the outer skirt and extending about the inner circumference of the outer skirt such that an inwardly projecting ridge portion is disposed between adjacent ones of the plurality of lid locking members;

wherein:

the plurality of lid locking members are each, independently, configured to flex, relative to the outer skirt;

each one of the plurality of lid locking members, independently, includes a lid-locking member support extending outwardly and away from an outer surface of the lid-locking member along the length of the lid locking member as measured along the outer perimeter of the outer skirt, the lid locking member support disposed downwardly relative to the distal end of the lid-locking member; and while the lid is disposed on the container such that the lid is disposed in a locked condition, such that the container is disposed in a closed condition:

the upper rim of the container is disposed within the container rim-receiving space;

the inwardly projecting ridge is disposed below the container lip;

the plurality of lid locking members are disposed relative to the container lip such that at least a portion of the distal end of each one of the plurality of lid locking members is disposed within the lid-locking receiving space defined by the container lip;

the plurality of lid locking members are disposed relative to the container lip such that the distal end of each of the plurality of lid locking members is disposed in a first position within the lid-locking receiving space; and the lid locking member support is disposed beneath the container lip such that application of an upwards force applied to the lid, relative to the container, is with effect that upwards displacement of the lid relative to the container such that the distal end of at least some of the plurality of lid locking members is displaced farther inwardly into the lid-locking receiving space beyond a predetermined amount is resisted by impingement of the lid locking member support against the container lip;

and each one of the plurality of lid locking members, independently, includes one or more support ribs disposed beneath the lid-locking member support and extending from the outer surface of the lid locking member; and the lid-locking member support and the one or more support ribs are cooperatively configured such that downwards deflection of the lid-locking member support rib, relative to the outer surface of the lid locking member, in response to impingement of the lid locking member support against the container lip due to upwards forces applied to the lid, relative to the container, while the lid is disposed in the container in the locked condition, is resisted.

16. The lid as claimed in claim 15;

wherein the one or more support ribs are arranged at spaced apart intervals along the outer surface of the respective one of the plurality of lid locking members.

17. The lid as claimed in claim 15;

wherein:

the inwardly projecting ridge defines a first surface wherein the first surface is configured for impinging the container lip in response to upwards forces applied to the lid, relative to the container, while the lid is disposed on the container in the locked condition; and the first surface extends parallel relative to a horizontal plane that intersects the outer skirt.

18. A lid for a container, the container having a closed bottom end and a container wall element defining an open, interior container space, the container wall element having an upper rim defining an open end of the container and including an outwardly projecting container lip defining a lid-locking receiving space, the lid comprising:

a central panel;

a peripheral member extending from a periphery of the central panel, the peripheral member having:

an inner wall member extending from the periphery of the central member;

an outer skirt defining an outer perimeter of the lid, wherein the outer skirt is disposed in spaced apart relationship from the inner wall member such that a container rim-receiving space is defined between the inner wall member and the outer skirt that is configured for receiving the upper rim of the container;

a plurality of lid locking members defined within the outer skirt and disposed at spaced apart intervals about the outer skirt, each one of the plurality of lid locking members, independently, extending from the outer skirt to a distal end that is free from connection to the outer skirt;

and an inwardly projecting ridge extending from an inner surface of the outer skirt and extending about the inner circumference of the outer skirt such that an inwardly projecting ridge portion is disposed between adjacent ones of the plurality of lid locking members;

wherein:

the plurality of lid locking members are each, independently, configured to flex, relative to the outer skirt;

each one of the plurality of lid locking members, independently, includes a lid-locking member support extending outwardly and away from an outer surface of the lid-locking member along the length of the lid locking member as measured along the outer perimeter of the outer skirt, the lid locking member support disposed downwardly relative to the distal end of the lid-locking member; and while the lid is disposed on the container such that the lid is disposed in a locked condition, such that the container is disposed in a closed condition:

the upper rim of the container is disposed within the container rim-receiving space;

the inwardly projecting ridge is disposed below the container lip;

the plurality of lid locking members are disposed relative to the container lip such that at least a portion of the distal end of each one of the plurality of lid locking members is disposed within the lid-locking receiving space defined by the container lip;

the plurality of lid locking members are disposed relative to the container lip such that the distal end of each of the plurality of lid locking members is disposed in a first position within the lid-locking receiving space; and the lid locking member support is disposed beneath the container lip such that application of an upwards force applied to the lid, relative to the container, is with effect that upwards displacement of the lid relative to the container such that the distal end of at least some of the plurality of lid locking members is displaced farther inwardly into the lid-locking receiving space beyond a predetermined amount is resisted by impingement of the lid locking member support against the container lip;

and each one of the plurality of lid locking members, independently, further comprises:

a plurality of lid locking member support ribs disposed at spaced apart intervals along an inner surface of the lid locking member for supporting the lid locking member relative to the outer skirt such that downwards deflection of each one of the plurality of lid locking members, independently, relative to the outer skirt, beyond a predetermined amount is resisted by the plurality of lid locking member support ribs.

19. The lid as claimed in claim 1;

wherein:

each one of the plurality of lid locking members, independently, includes one or more support ribs extending outwardly from the outer surface of the respective one of the plurality of lid locking members, wherein the one or more support ribs are arranged at spaced apart intervals along the outer surface of the respective one of the plurality of lid locking members; and while the lid is disposed on the container such that the lid is disposed in a locked condition, such that the container is disposed in a closed condition:

the plurality of lid locking members are disposed relative to the container lip such that the distal end of each of the plurality of lid locking members is disposed in a first position within the lid-locking receiving space; and the one or more of the support ribs disposed on the outer surface of each one of the plurality of lid locking members, independently, are disposed beneath the container lip such that application of an upwards force applied to the lid, relative to the container, is with effect that upwards displacement of the lid relative to the container such that the distal end of at least some of the plurality of lid locking members is displaced farther inwardly into the lid-locking receiving space beyond a predetermined amount is resisted by impingement of the one or more of the support ribs against an end edge of the container lip.

20. The lid as claimed in claim 1;

wherein:

the lid is one of: a circular-shaped lid configured for cooperating with a container having a corresponding circular cross-section, a square-shaped lid configured for cooperating with a container having a corresponding square cross-section, an elliptical-shaped lid configured for cooperating with a container having a corresponding elliptical cross-section, a rectangular shaped-lid configured for cooperating with a container having a corresponding rectangular cross-section, and a parallelogram-shaped lid configured for cooperating with a container having a corresponding parallelogram-shaped cross-section.

* * * * *